US011250999B2

(12) United States Patent
Sagong

(10) Patent No.: US 11,250,999 B2
(45) Date of Patent: Feb. 15, 2022

(54) WATERPROOF SWITCH DEVICE, AND WATERPROOF SWITCH MODULE FOR TRUNK DOOR OF CAR

(71) Applicant: Switch Korea Co., Ltd., Incheon (KR)

(72) Inventor: Bong Sagong, Incheon (KR)

(73) Assignee: Switch Korea Co., Ltd., Incheon (KR)

( * ) Notice: Subject to any disclaimer, the term of this patent is extended or adjusted under 35 U.S.C. 154(b) by 0 days.

(21) Appl. No.: 16/931,533

(22) Filed: Jul. 17, 2020

(65) Prior Publication Data

US 2021/0391127 A1 Dec. 16, 2021

(30) Foreign Application Priority Data

Jun. 12, 2020 (KR) ..... 10-2020-0071562

(51) Int. Cl.
*H01H 13/06* (2006.01)
*H01H 1/58* (2006.01)
*H01H 13/18* (2006.01)

(52) U.S. Cl.
CPC ..... *H01H 13/06* (2013.01); *H01H 1/58* (2013.01); *H01H 13/18* (2013.01); *H01H 2229/044* (2013.01)

(58) Field of Classification Search
CPC ..... H01H 13/06; H01H 13/18; H01H 1/58; H01H 2223/002; H01H 9/04; H01H 13/86; H01H 2009/048; H01H 13/063; H01H 21/08; H01H 11/0056; H01H 2009/04
See application file for complete search history.

(56) References Cited

U.S. PATENT DOCUMENTS 4,877,930 A * 10/1989 Fukuma ..... H01H 9/04 200/302.2
2011/0284351 A1* 11/2011 Kitahara ..... H01H 13/06 200/341

FOREIGN PATENT DOCUMENTS

| | | | |
|---|---|---|---|
| JP | H 07-73776 | A | 3/1995 |
| JP | 3391172 | B2 | 3/2003 |
| JP | 2013-225423 | A | 10/2013 |
| KR | 20-1998-0054193 | U | 10/1998 |
| KR | 10-0254532 | B1 | 5/2000 |
| KR | 10-2005-0114783 | A | 12/2005 |
| KR | 10-2017-0008425 | A | 1/2017 |

* cited by examiner

*Primary Examiner* — Ahmed M Saeed
(74) *Attorney, Agent, or Firm* — Daly Crowley Mofford & Durkee, LLP

(57) ABSTRACT

A waterproof switch device and a waterproof switch module for a vehicle trunk door employing the same are disclosed. Without using a PCB, terminal leads and a pair of switch terminal parts providing switch terminals are integrated with the switch bracket by injection molding. A push button unit is capable of switching the exposed switch terminals and is also sealingly coupled to the top side of the switch bracket so that the space containing the switch terminals and the switch contacts is waterproof. The lead portions of the switch terminals and the switch cables are connected in the terminal receiving space of the switch bracket, and the waterproofing part fills the terminal receiving space so that they are completely embedded so as to be waterproof. The waterproof switch module for a vehicle trunk door adopts the waterproof switch device and is composed of a double waterproof structure by applying an additional waterproof structure.

19 Claims, 18 Drawing Sheets

CROSS-SECTIONAL VIEW ALONG CUTTING LINE A-A'

CROSS-SECTIONAL VIEW ALONG CUTTING LINE B-B'

CROSS-SECTIONAL IMAGE OF NOTCHING STRUCTURE 49a OR 49b

CROSS-SECTIONAL VIEW ALONG CUTTING LINE C-C'

WATERPROOF SWITCH DEVICE, AND WATERPROOF SWITCH MODULE FOR TRUNK DOOR OF CAR

CROSS-REFERENCE TO RELATED APPLICATION

This U.S. non-provisional application claims priority under 35 USC § 119 from Korean Patent Application No. 10-2020-0071562, filed on Jun. 12, 2020 in the Korean Intellectual Property Office (KIPO), the disclosure of which is hereby incorporated by reference in its entirety.

BACKGROUND

1. Technical Field

The present invention relates to a switch device, and more particularly to a waterproof switch device that does not use a printed circuit board (PCB) and a waterproof switch module for a vehicle trunk door using the same.

2. Discussion of the Related Art

In general, a trunk door for a vehicle is equipped with a trunk door switch that performs a switching operation such that the trunk interior light is turned on when the trunk door is opened and the trunk interior light is turned off when it is closed.

FIG. 1 is a photograph of a conventional vehicle trunk door switch 1 that is commercially available. In the conventional vehicle trunk door switch 1, a general switch 3 is mounted on a PCB 2, and a cable soldering portion 4 is provided on the PCB 2. The cable soldering portion 4 can be connected to the general switch 3 as well as with an external cable (not shown) for transmitting a switching signal by soldering. In addition, an injected insulation plate 5 is added to the bottom of the PCB 2, and a molding part 6 for waterproofing the back surface is provided to cover and close the injected insulation plate 5.

The conventional vehicle trunk door switch 1 having such a configuration is built in a bracket housing (not shown) and can have a waterproof function by being sealed by the molding part 6. The vehicle trunk door switch 1 embedded in the bracket housing and sealed with a molding part 6 may be referred to as a bracket assembly.

The conventional vehicle trunk door switch 1 can be produced through the several processes such as fabricating the general switch and the PCB, assembling the general switch and the PCB, connecting the cable by soldering to the cable soldering portion, assembling the bracket assembly (assembled to a front case), forming the molding part with epoxy, etc.

By the way, the conventional vehicle trunk door switch 1 is a PCB based switch since it employs the PCB 2 as an essential component. Thus, it is essentially needed to perform the processes such as manufacturing the PCB 2, assembling the general switch 3 and the PCB 2, soldering connection between the cable soldering portion 4 of the PCB 2 and the external cable, and the like. Accordingly, there are several disadvantages such as increase of the number of assembly steps, productivity decrease, and cost increase. These disadvantages are mainly caused by employing the PCB 2.

SUMMARY

The present invention is to solve the problems mentioned above. It is an object of the present invention to provide a waterproof switch device designed as a compact structure that the switch terminals can be directly connected to the cable without using a PCB, thereby reducing assembly works and manufacturing costs, and providing complete waterproof properties.

It is another object of the present invention to provide a waterproof switch module for a vehicle trunk door having a dual waterproof structure by employing the waterproof switch device as well as applying an additional waterproof structure thereto.

The problem to be solved by the present invention is not limited to the above-described problems, and may be variously extended without departing from the spirit and scope of the present invention.

A waterproof switch device according to exemplary embodiments of the present invention for achieving the above object includes a switch bracket, first and second switch terminal parts, first and second switch cables, a push button unit, and a waterproof part. The switch bracket includes a top side and sidewalls, and provides a terminal receiving space surrounded by the top side and the side walls. The first and second switch terminal parts include first and second switch terminals, each of which is at least partially exposed to an outer surface of the top side of the switch bracket, and first and second terminal lead portions, each of which is at least partially exposed to the terminal receiving space, respectively. A first remaining portion of the first switch terminal and the first terminal lead portion and a second remaining portion of the second switch terminal, and the second terminal lead portion are embedded inside the switch bracket to be integral with the switch bracket. Terminal wires of the first and second switch cables are electrically connected to the exposed portions of the first and second terminal leads, respectively, and located in the terminal receiving space, and the remaining sections of the first and second switch cables are extended out of the terminal receiving space. The push button unit includes a switch contact disposed to turn on or off the first and second switch terminals according to whether a pressing force is applied or not, and is coupled to the top side of the switch bracket such that a switch contact space receiving the first and second switch terminals and the switch contact is sealed to be waterproof. The waterproof part fills the terminal receiving space so that the exposed portions of the first and second terminal lead portions and the first and second switch cables in the terminal receiving space are completely embedded to be waterproof in the waterproof part.

In an exemplary embodiment, the switch bracket may be an insulating plastic manufactured by an injection molding process so that the first and second remaining portions of the first and second switch terminal parts are embedded therein.

In an exemplary embodiment, ends of the first and second remaining portions of the first and second switch terminal parts embedded in the switch bracket may be extended to the side wall of the switch bracket and exposed to an outside. Surfaces of predetermined sections up to the ends of the first and second remaining portions may be formed with bumpy notching structures for preventing moisture from permeating along the surfaces, respectively.

In an exemplary embodiment, the waterproof part may be formed using a resin filled and cured in the terminal receiving space, wherein the resin includes at least one of epoxy, silicone, and urethane.

In an exemplary embodiment, the switch bracket may include a terminal case including a stem mounting unit and a terminal fixing piece. The stem mounting unit may provide a switch contact receiving space which is surrounded by a side wall of a certain height on the top side and has an open top. The terminal fixing piece may be positioned below the stem mounting unit while forming a bottom of the switch contact receiving space and the first and second remaining portions of the first and second switch terminal parts, respectively, may be are embedded in the terminal fixing piece.

In an exemplary embodiment, the push button unit may include a switch contact, a sealing member, a stem, and a cover. The switch contact may be disposed in the switch contact receiving space to maintain contact with the first switch terminal at all times, and may be configured to be contacted with the second switch terminal only while a downward pressure is applied to the switch contact. The sealing member may be hermetically sealed to a top side of the stem mounting portion so that the switch contact receiving space is completely covered and waterproof, and may be in contact with or close to a top surface of the switch contact. The stem may be disposed on the sealing member, and may be a cylindrical shape having a stepped lateral side by a lower portion of the stem which is thicker than an upper portion of the stem. The cover is configured to be coupled with the sealing member while being superimposed on the sealing member, and to allow the upper portion of the stem to insert through the cover. The cover is configured to prevent the lower portion of the stem from escaping out of the cover by engaging the stepped lateral side, and to provide a space for the stem to move up and down.

In an exemplary embodiment, the sealing member may include an annular flat portion that is sealingly bonded to the entire top side of the stem mounting portion by a waterproof adhesive; an annular pushing guide protrusion protruding outward while being surrounded by the flat portion and sinking downward; and a pushing block portion protruding downward a center of the pushing guide protrusion and disposed in contact or close to a center portion of the top side of the dome-shaped contact so as to uniformly press the dome-shaped contact. The annular flat portion, the pushing guide protrusion, and the pushing block portion may form a single body.

In an exemplary embodiment, the sealing member may be made of any one of rubber, silicone, and urethane having a waterproof property.

In an exemplary embodiment, the switch contact may be a dome-shaped elastic conductor of which central portion is convex, so that the switch contact can be deformed into a shape that the central portion comes to be substantially equal to the edge portion in level by a downward pressure applied to the central portion, and can be restored to an original dome shape when the downward pressure is released.

In an exemplary embodiment, the switch bracket may further include a partition wall protruding downward from a bottom surface of the terminal fixing piece in the terminal receiving space to physically separate the first and second switch terminal parts.

In an exemplary embodiment, the switch bracket may further include cable guide portions formed on an inner surface of the side wall side by side on both sides of the separation wall, and configured to receive the first and second switch cables to guide the first and second switch cables to be located on both sides of the separation wall.

In an exemplary embodiment, the first and second switch terminal parts may be configured such that they are exposed only to the terminal receiving space without being exposed through the side wall of the switch bracket.

In an exemplary embodiment, the push button unit may include a switch contact and a waterproof cover. The switch contact may be configured to be disposed on the first and second switch terminals to maintain contact with the first switch terminal at all times, and to be contacted with the second switch terminal only while a downward pressure is applied. The waterproof cover is bonded to the top side of the switch bracket while covering all of the first and second switch terminals and the switch contact, thereby sealing a receiving space, which is formed in cooperation with the top side of the switch bracket to encapsulate the first and second switch terminals and the switch contact, to be waterproof.

Meanwhile, a waterproof switch module for a vehicle trunk door according to exemplary embodiments of the present invention for achieving the above object includes a waterproof switch device according to any one of the above embodiments, a case unit, and an elastic pressing part. The case unit includes upper and lower cases that are press-fitted to each other and configured to provide a waterproof switch receiving space containing the waterproof switch device. A central portion of the upper case is opened, and a close-looped groove or convex for waterproofing is formed along a periphery of the receiving space on a top side of the lower case. The elastic pressing part is combined with the upper case to completely cover the open central portion of the upper case. A close-looped convex or groove for waterproofing formed circumferentially along an edge of the elastic pressing unit is press-fitted into the close-looped groove or convex for waterproofing formed on the lower case to block water penetration into the waterproof switch receiving space. A portion of a bottom of the elastic pressing part may be disposed to contact the push button unit of the waterproof switch device.

In an exemplary embodiment, the lower case may include a pair of switch support parts fixed upright to the bottom, spaced apart from each other, and provided with a locking jaw at an upper portion, wherein the pair of switch support parts elastically support the press-fitted waterproof switch device, thereby fixing the press-fitted waterproof switch device not to be taken out.

In an exemplary embodiment, the waterproof switch module for the vehicle trunk door may further include an elastic waterproof pad disposed between a pair of switch supports on the bottom of the lower case, and on which the waterproof switch device is placed, thereby improving waterproofness of a lower side of the waterproof switch device.

The waterproof switch device according to the present invention does not need to employ a PCB because the switch terminal parts providing switch terminals and terminal leads for cable connection are integrated with the switch bracket. Thus, the PCB manufacturing process and the assembly process based on the PCB can be omitted. As a result, the number of assembly steps required to manufacture the waterproof switch device can be reduced as a whole, and the process for manufacturing the waterproof switch device can be simplified, thereby improving productivity and reducing costs.

Since the waterproof switch device according to the present invention is based on a structure, without using the PCB, in which the switch bracket is integrated with the switch terminal parts by the injection molding process with the insulating resin, it is easy to provide the switch bracket with a contact space for the switch terminals and a space for connecting the switch cables. Then, such spaces can be sealed to be waterproof with a sealing cover or a sealing film, or waterproofed by a simple method of filling a waterproof resin to fill the space. This ensures a complete waterproof structure for all conductor parts of the switch device.

Since the waterproof switch device according to the present invention has a completely waterproof structure, it can be applied to various use environments requiring good waterproof properties. As a typical example, the waterproof switch device can be used as a waterproof switch module for the vehicle trunk door. Since the waterproof switch module for the vehicle trunk door according to the present invention has a separate waterproof structure of the case unit and the elastic pressing part which house the waterproof switch device, in addition to the waterproof structure of the waterproof switch device, the waterproof switch device can be protected by a double waterproof structure.

BRIEF DESCRIPTION OF THE DRAWINGS

These and/or other aspects and advantages of the present general inventive concepts will become apparent and more readily appreciated from the following description of the embodiments, taken in conjunction with the accompanying drawings of which.

DETAILED DESCRIPTION OF THE EMBODIMENTS

Figure 1:
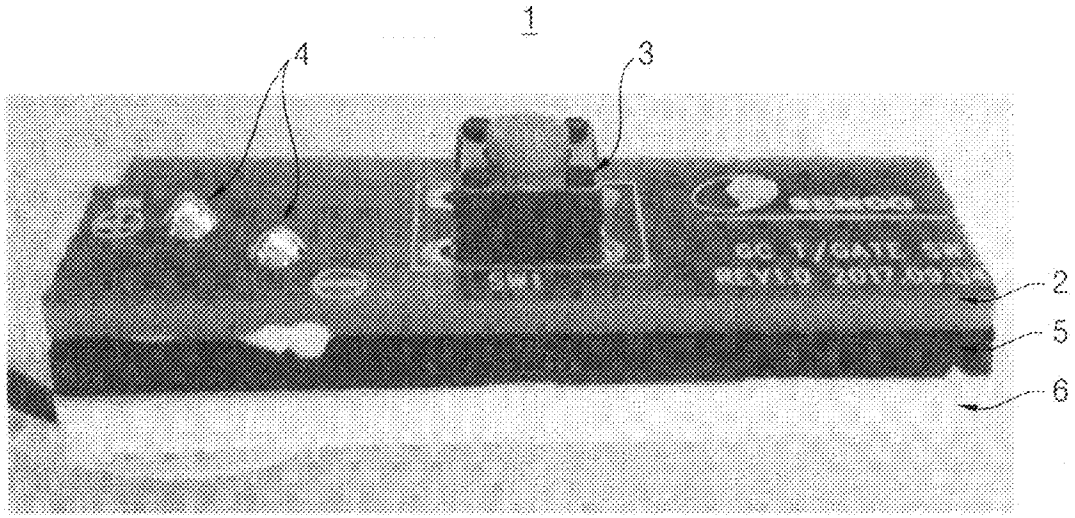
FIG. 1 is a photo showing a structure of a conventional PCB-based trunk door switch.

Hereinafter, preferred embodiments of the present invention will be described in detail with reference to the accompanying drawings. The same reference numerals are used for the same components in the drawings, and duplicate descriptions for the same components are omitted.

For the embodiments of the present invention disclosed in the text, specific structural or functional descriptions are exemplified only for the purpose of illustrating the embodiments of the present invention. Embodiments of the present invention may be implemented in various forms, and should not be construed as being limited to the embodiments described in the text. That is, the present invention can be applied to various changes, and may have various forms, and specific embodiments will be illustrated in the drawings and described in detail in the text. However, this is not intended to limit the present invention to a specific disclosure form, and it should be understood as including all modifications, equivalents, and substitutes included in the spirit and scope of the present invention.

The terms used in the present invention are only used to describe specific embodiments, and are not intended to limit the present invention. Singular expressions include plural expressions unless the context clearly indicates otherwise. In this application, the terms "include" or "have" are intended to indicate the presence of features, numbers, steps, actions, components, parts or combinations thereof described in the specification, one or more other features. It should be understood that the existence or addition possibilities of fields or numbers, steps, operations, components, parts or combinations thereof are not excluded in advance. When a component is described as being "connected", "coupled" or "connected" to another component, that component may be directly connected to or connected to the other component, but another component between each component It should be understood that may be "connected", "coupled" or "connected". Further, terms such as first and second may be used to describe various components, but the components should not be limited by the terms. The terms are used only for the purpose of distinguishing one component from other components.

Figure 2:
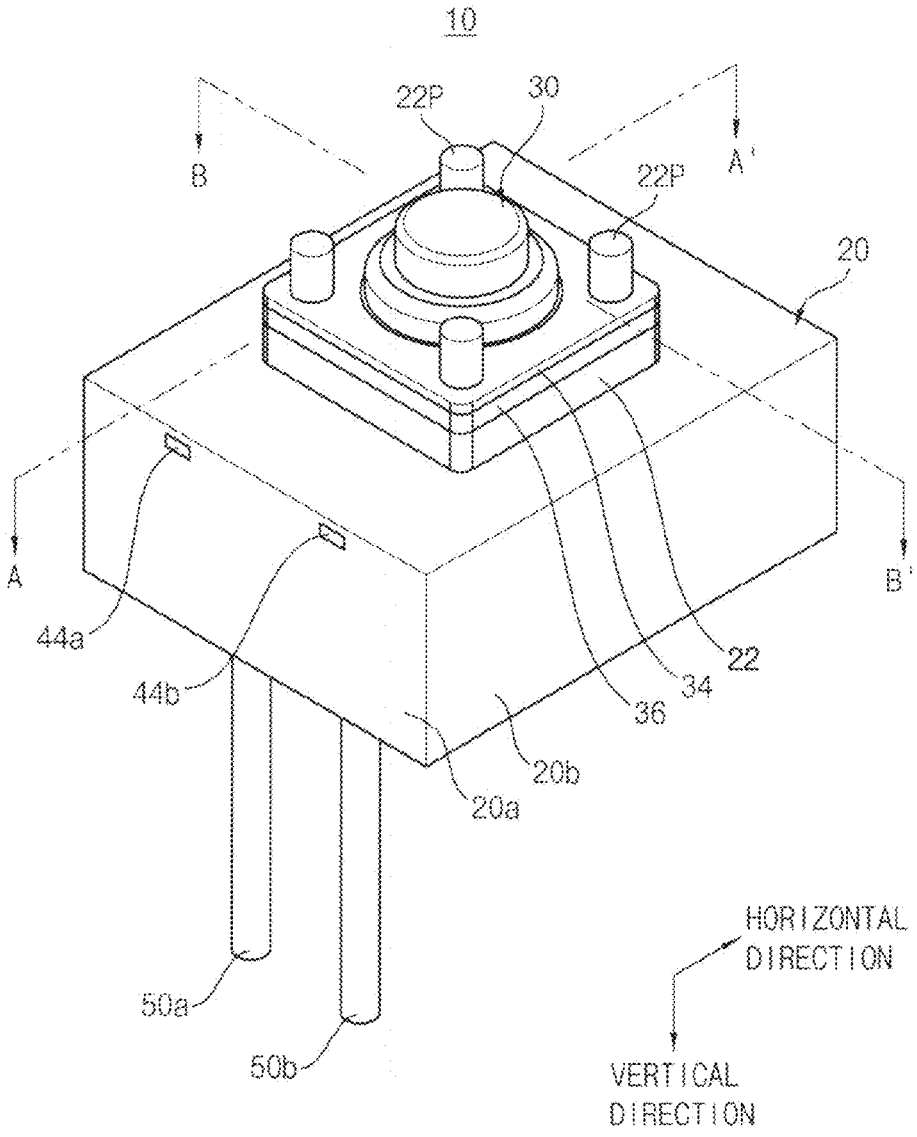
FIG. 2 is a perspective view of an assembled waterproof switch according to a first exemplary embodiment of the present invention.
Figure 3:
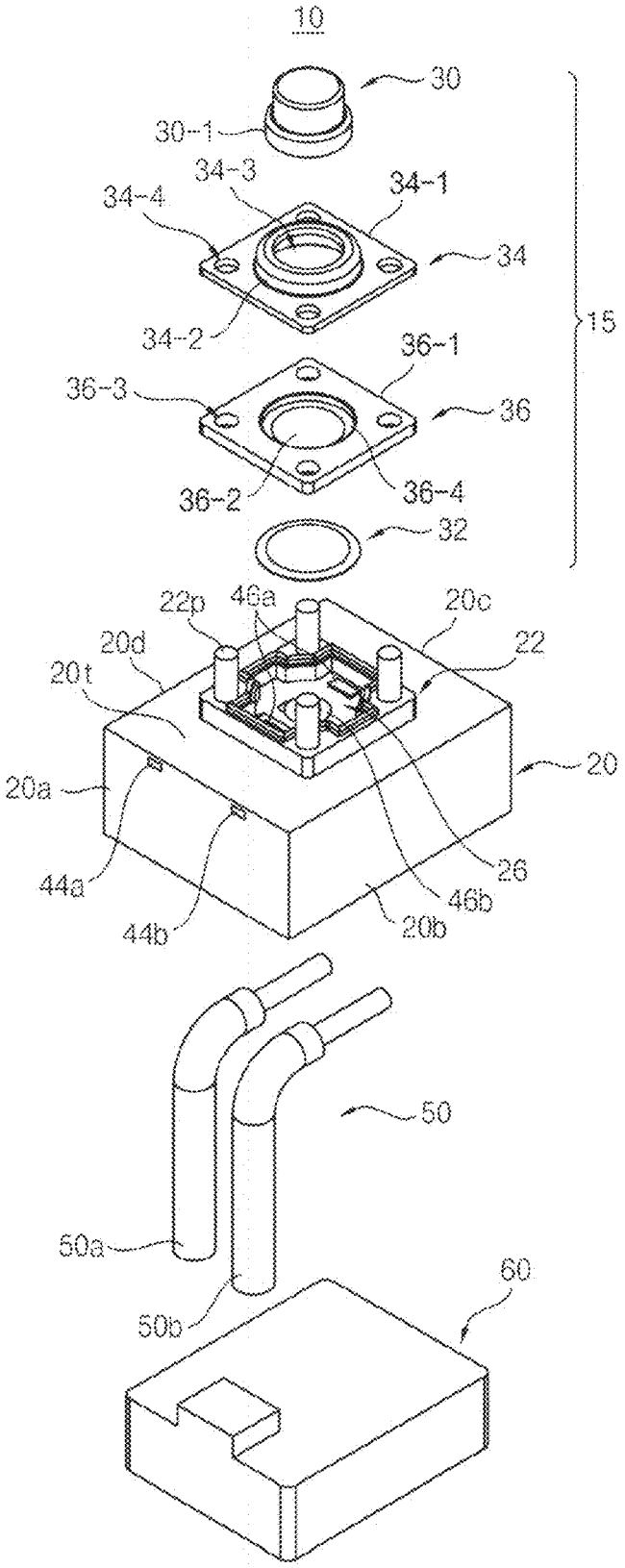
FIG. 3 is an exploded perspective view of the waterproof switch shown in FIG. 2.
Figure 4:
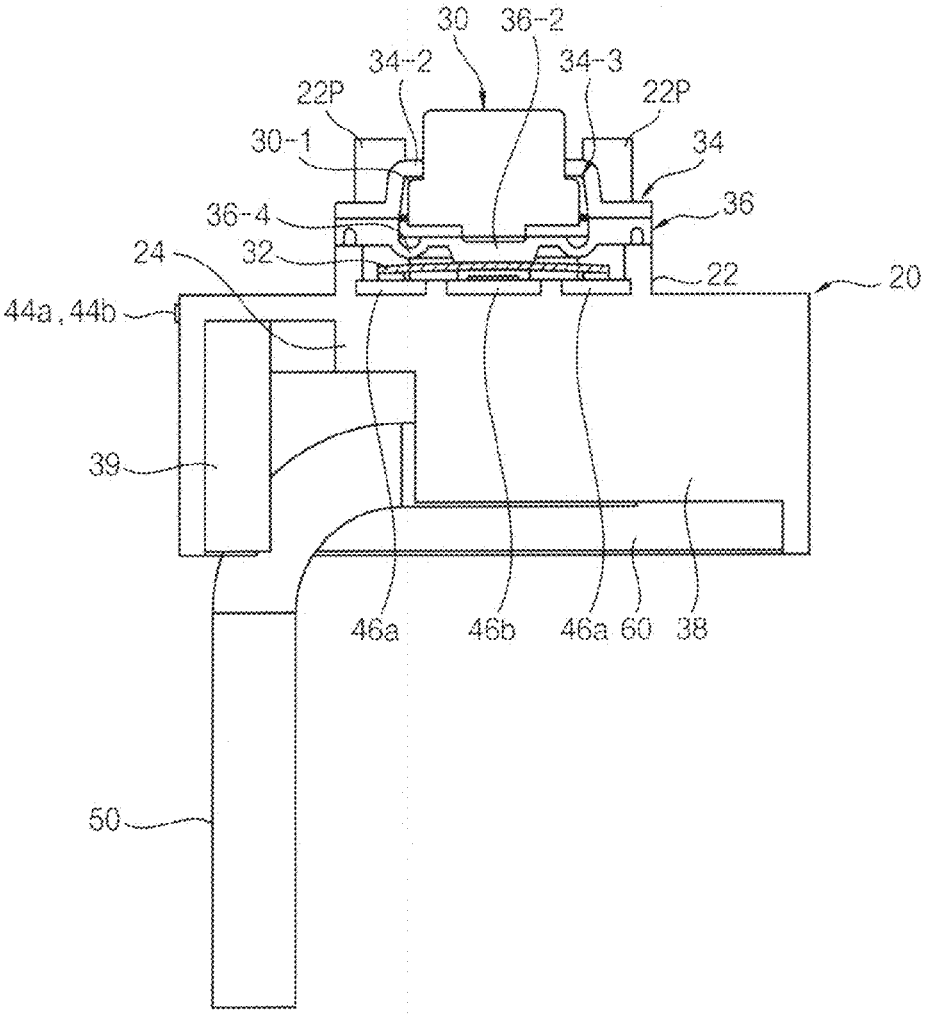
FIG. 4 is a cross-sectional view taken along line A-A' in FIG. 2.
Figure 5:
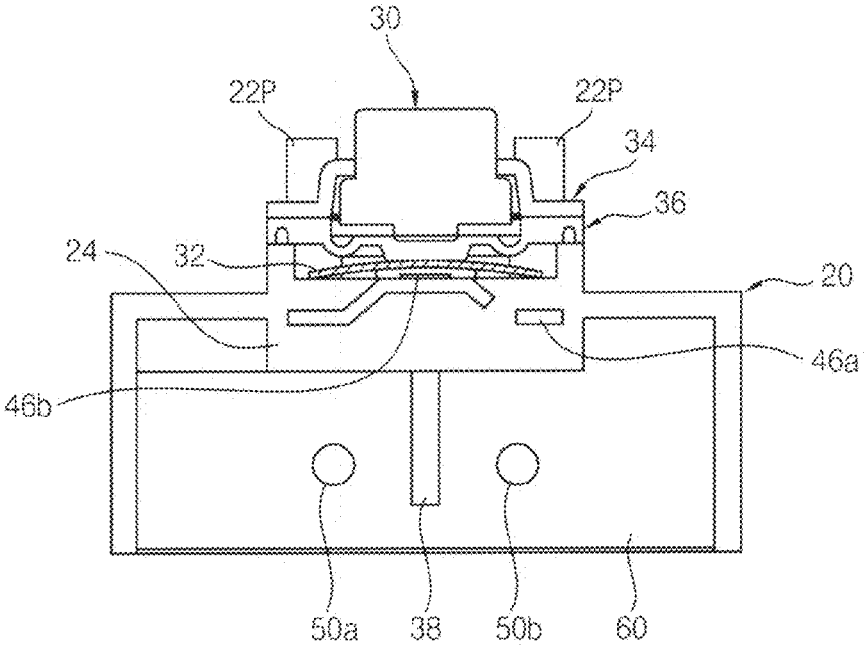
FIG. 5 is a cross-sectional view taken along line B-B' in FIG. 2.

FIG. 2 illustrates a perspective view showing an assembled state of a waterproof switch device 10 according to an exemplary embodiment, and FIG. 3 illustrates an exploded perspective view of the waterproof switch device 10. FIGS. 4 and 5 are cross-sectional views when the waterproof switch device 10 shown in FIG. 2 is cut along two cutting lines A-A' and B-B', respectively, orthogonal to each other.

Referring to FIGS. 2 to 5, the waterproof switch device 10 may include a push button unit 15, a switch terminal unit 40, a switch bracket 20, switch cables 50 for transferring switching signals, and a waterproof part 60.

The switch terminal unit 40 may include a first switch terminal part 40*a* and a second switch terminal part 40*b*. The first switch terminal part 40*a* may include a switch terminal 46*a* for switching on/off and first terminal lead portions 42*a* and 44*a* extending from the switch terminal 46*a*. The second switch terminal part 40*b* may include a switch terminal 46*b* for switching on/off, and second terminal lead portions 42*b* and 44*b* extending from the switch terminal 46*b*. The first terminal lead portions 42*a* and 44*a* and the second terminal lead portions 42*b* and 44*b* may be partially embedded in the switch bracket 20, and the remaining portion may be extended into a terminal receiving space 28 provided by the switch bracket 20. The switch terminals 46*a* and 46*b* may be exposed outside the switch bracket 20.

The push button unit 15 may turn on or off the switch terminals 46*a*, and 46*b* of the switch terminal unit 40 according to whether a pressing force is applied. In addition, the push button unit 15 may be coupled with the switch bracket 20 to seal the first receiving space 26 so as to prevent water intrusion to the switch terminal unit 40 from the outside.

The switch bracket 20 may be integrally coupled with the pair of switch terminal parts 40*a*, and 40*b* in the form of embedding a portion of the pair of switch terminal parts 40*a*, and 40*b* therein as mentioned above. In addition, the switch bracket 20 may provide a first receiving space in which the switch terminals 46*a* and 46*b* are exposed outside and a switch contact 32 is received, that is, a switch contact receiving space 26 and a second receiving space, that is, a terminal receiving space 28, to which the vertical terminal lead portions 42*a*, 42*b* of the pair of switch terminal parts 40*a*, and 40*b* are exposed.

The switch cables 50 may include a pair of cables 50*a*, and 50*b*. The terminal wires from which the insulating coatings of the two switch cables 50*a* and 50*b* are removed are connected to the vertical terminal lead portions 42*a* and 42*b* of the pair of switch terminal parts 40*a* and 40*b*, respectively, in the terminal receiving space 28, and the remaining sections insulated with the insulating coating partially extends out of the terminal receiving space 28.

The waterproof part 60 may be coupled with the switch bracket 20 while filling up the terminal receiving space 28. Thus, the waterproof part 60 prevents the vertical terminal lead portions 42*a* and 42*b* of the pair of switch terminal parts 40*a*, and 40*b*, and parts of the pair of switch cables 50*a* and 50*b*, which are present in the terminal receiving space 28, from moisture penetration.

In an exemplary embodiment, the switch bracket 20 may be a shape of rectangular case which has a tetragonal top side 20*t* and four side walls 20*a*, 20*b*, 20*c*, and 20*d* connected to the four corners of the tetragonal top side 20*t*, and of which bottom is open. The space surrounded by the top side 20*t* and the four side walls 20*a*-20*d* of the switch bracket 20 may be provided as the terminal receiving space 28 that receives and connects the pair of switch terminal parts 40*a* and 40*b*, and the switch cables 50.

The switch bracket 20 may include a terminal case including a stem mounting unit 22 and a terminal fixing piece 24 integrally coupled thereunder.

The stem mounting unit 22 may be formed on the top side 20*t* of the switch bracket 20. As an example, the stem mounting unit 22 may be a circular or polygonal side wall structure upwardly protruding by a height and its top side may be a flat. In the drawing, a rectangular side wall structure is illustrated. There is provided a central space surrounded by the polygonal side wall structure, and its upper part is opened, so that the central space can be provided as the switch contact receiving space 26. A plurality of protruding pins 22P may be provided at a plurality of points on the top side of the stem mounting unit 22. That is, the plurality of protruding pins 22P may be disposed around the switch contact receiving space 26.

The terminal fixing piece 24 may be provided in a form protruding downward from the stem mounting unit 22 while partially forming the bottom of the switch contact receiving space 26. Portions of the first and second horizontal terminal lead portions 44*a*, 44*b*, which are part of the first and second switch terminal parts 40*a*, and 40*b*, and bases of the first and second switch terminals 46*a*, and 46*b* are spaced apart from each other and embedded in the terminal fixing piece 24, and the vertical terminal lead portions 42*a* and 42*b* of the first and second terminal parts 40*a* and 40*b* may extend out of the terminal fixing piece 24. The first and second switch terminals 46*a* and 46*b* may be partially exposed while their bases are embedded in the bottom of the switch contact receiving space 26. At the bottom of the switch contact receiving space 26, two common terminals 46*a* of the first switch terminal part 40*a* are spaced apart from each other, and a contact terminal 46*b* of the second switch terminal part 40*b* may be disposed between the two common terminals 46*a*. As such, the first and second switch terminal parts 40*a* and 40*b* may be integrally coupled to the switch bracket 20 through the terminal fixing piece 24.

In an exemplary embodiment, the push button unit 15 may include a stem 30, a switch contact 32, a cover 34, and a sealing member 36.

The switch contact 32 may be disposed in the switch contact receiving space 26 to always maintain contact with the first switch terminal (i.e., common terminal) 46*a*, and may be configured to be contacted to the second switch terminal (i.e., contact terminal) 46*b* only while a downward pressure is being applied to the switch contact 32. That is, the switch contact 32 may be configured to turn on or off the first and second switch terminals 46*a* and 46*b* depending on whether a pressing force is applied. In an exemplary embodiment, the switch contact 32 may be a circular, but a dome-shaped contact that gradually increases in height from the edge to the center when viewed from the side. The dome-shaped contact 32 may be disposed in the switch contact receiving space 26. In a state the dome-shaped contact 32 is seated in the switch contact receiving space 26, an edge portion of the dome-shaped contact 32 maintains contact with the two common terminals 46*a* of the first switch terminal part 40*a*, while a center portion of the dome-shaped contact 32 may maintain a non-contact state (i.e., a switch-off state) with the contact terminal 46*b* of the second switch terminal part 40*b*. As an example, the dome-shaped contact 32 may be made of a highly elastic conductor, so that an external force pressing the dome-shaped contact 32 can make its center portion be lowered and brought into contact with the second switch terminal part 40*b* (turned on), but the dome-shaped contact 32 can restore its original shape and thus return to a non-contact state (turned off) when the external force is removed.

The sealing member 36 may be fixed to the top side of the stem mounting unit 22 so as to completely seal the switch contact receiving space 26 to be waterproof and may be in contact with or close to the top of the dome-shaped contact 32. In an exemplary embodiment, the sealing member 36 may include a flat portion 36-1, a pushing guide protrusion portion 36-4, and a pushing block portion 36-2. The flat portion 36-1 is annular, and may be completely hermetically bonded to the entire top side of the stem mounting unit 22 with, for example, a waterproof adhesive. The pushing guide protrusion portion 36-4 may be annular and sunken to protrude downward while being surrounded by the flat portion 36-1. The pushing block portion 36-2 may protrude downward from the center of the pushing guide protrusion portion 36-4 and be disposed in contact with or close to the top of the dome-shaped contact 32. The pushing guide protrusion portion 36-4 and the pushing block portion 36-2 may be concentrically arranged based on the center of the sealing member 36. The outer bottom surface of the pushing block portion 36-2 may be in close proximity to or in contact with the top of the dome-shaped contact 32, and the stem 30 may be placed on the inner sink of the pushing block portion 36-2. A plurality of pin insertion holes 36-3 may be formed in the flat portion 36-1 of the sealing member 36. The sealing member 36 may be made of a material such as rubber, silicone, urethane, or the like, which has excellent water resistance. If a plurality of protruding pins 22P is inserted into the plurality of pin insertion holes 36-3 for assembling, the sealing member 36 may completely cover the top side of the stem mounting unit 22. By bonding the sealing member to the top side of the stem mounting unit 22 with an adhesive for waterproof in this state, the switch contact receiving space 26 can be sealed by the sealing member 36 to become a waterproof space.

The stem 30 may be a cylindrical shape as a whole, and a lower portion of the stem 30 is provided with a stem flange portion 30-1 thicker than an upper portion. A step may be formed between the upper and lower portions of the stem 30. The stem 30 may be disposed on the sealing member 36. The lower portion of the stem 30 may be received in the inner sink of the pushing block portion 36-2 of the sealing member 36.

The cover 34 may be superimposed on and bonded to the sealing member 36, allowing the upper portion of the stem 30 to insert through itself, and engaging with the stepped lateral side of the stem 32 so that the lower portion of the stem 30 does not escape out from the cover 34, while providing a space for the stem 30 to move up and down. In an exemplary embodiment, the cover 34 may include a flat portion 34-1 that abuts the flat portion 36-1 of the sealing member 36, and a stem stopper 34-2 that protrudes upward from the center portion of the flat portion 34-1 and has an annular structure provided with a stem coupling hole 34-3. A plurality of pin insertion holes 34-4 may be formed in the flat portion 34-1. A plurality of protruding pins 22P may be inserted into the plurality of pin insertion holes 34-4. The lower diameter of the stem engaging hole 34-3 of the stem stopper 34-2 is larger than the diameter of the stem flange portion 30-1, but the upper diameter is smaller than the diameter of the stem flange portion 30-1 but larger than the upper diameter of the stem 30.

The stem 30 may be inserted into the stem coupling hole 34-3 provided in the cover 34 from the bottom up so that the stem 30 can move vertically through the stem coupling hole 34-3 with respect to the cover 34. The stem flange portion 30-1 may be caught by the stem stopper 34-2 and do not come out, and only the upper portion of the stem 30 may protrude out of the pin insertion hole 34-3.

Figure 6:
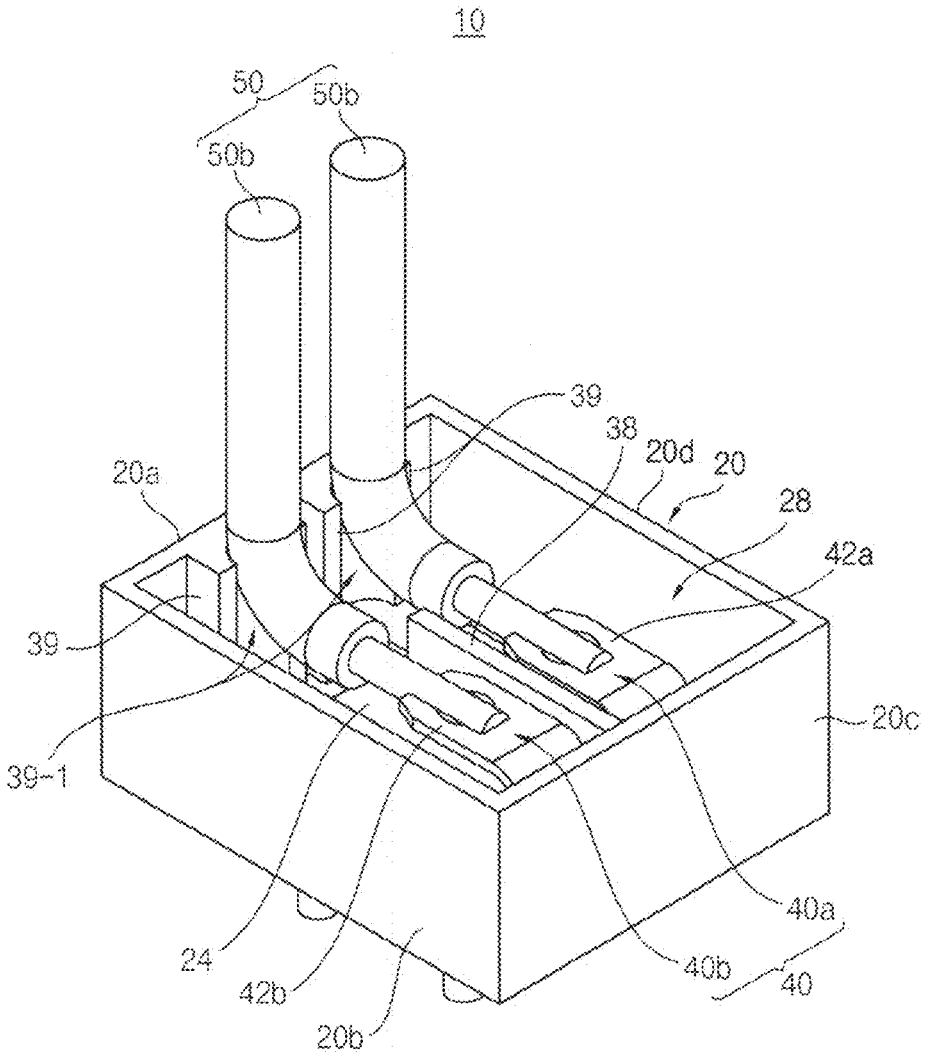
FIG. 6 is a rear perspective view showing a state in which switch terminal parts are connected to switch cables which are seated on a cable guide part of the waterproof switch according to the exemplary embodiment of the present invention.
Figure 7:
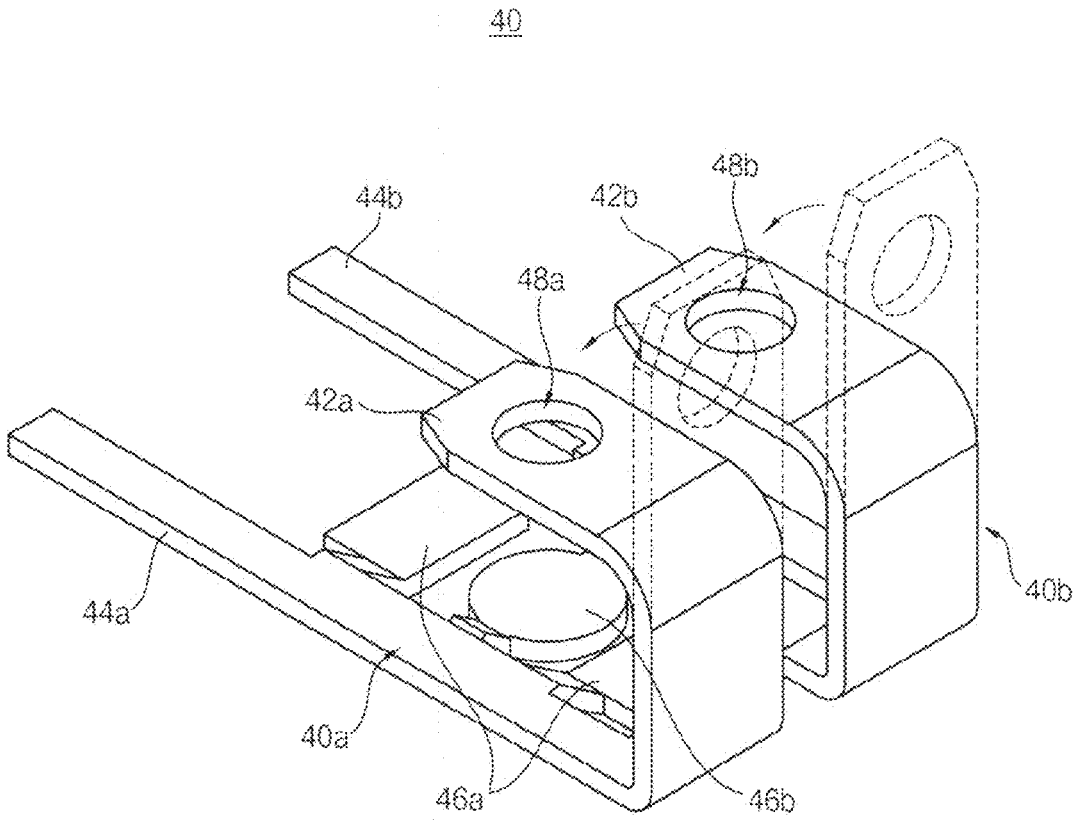
FIGS. 7 and 8 are perspective views of the switch terminal parts of the waterproof switch according to the exemplary embodiment of the present invention when viewed from two different diagonal directions, respectively.
Figure 8:
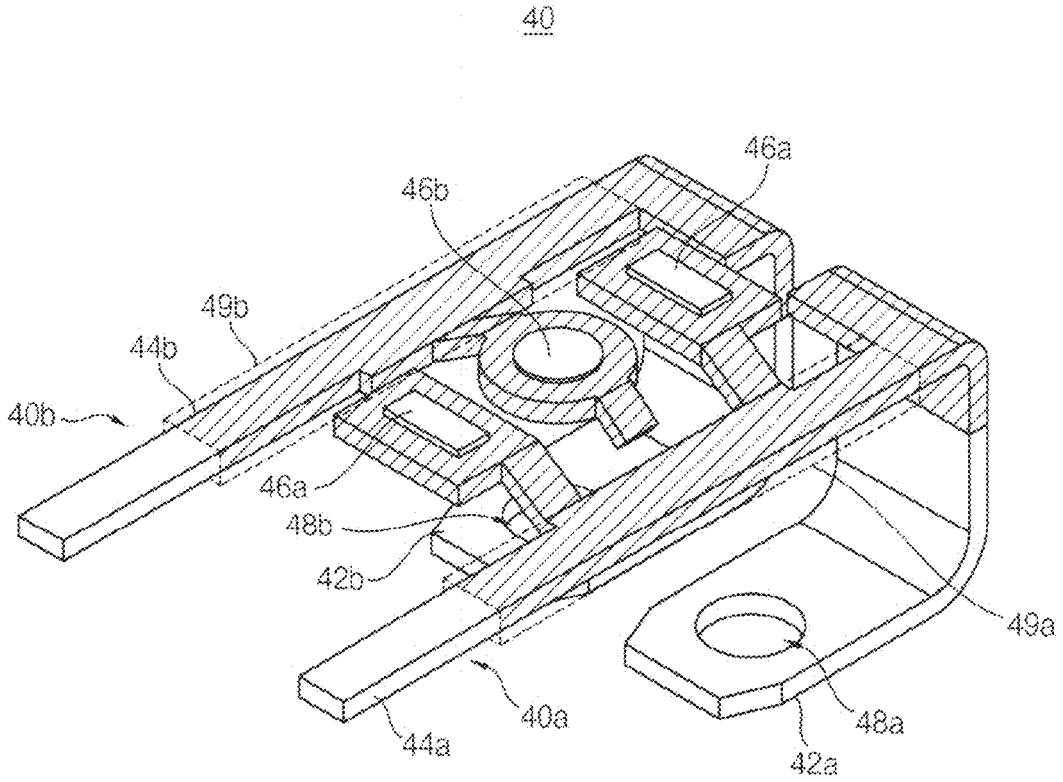

FIG. 6 is a perspective view showing a state in which the switch cables 50 are seated on a cable guide part 39 of the waterproof switch device 10 and connected to the switch terminal unit 40. FIGS. 7 and 8 are perspective views of the switch terminal unit 40 according to the exemplary embodiment, as seen from two different diagonal directions.

With reference to FIGS. 6 to 8, the first switch terminal part 40*a* may include two common terminals 46*a* and the first terminal lead portion which are integrally connected to each other. The first terminal lead portion may include the first horizontal terminal lead portion 44*a* extending horizontally and the first vertical terminal lead portion 42*a* extending vertically from one end of the first horizontal terminal lead portion 44*a*. The two common terminals 46*a* may be spaced apart by a predetermined distance, and connected to each other through the first horizontal terminal lead portion 44*a*.

The second switch terminal part 40*b* may include the contact terminal 46*b* and the second terminal lead portion which are integrally connected to each other. The second terminal lead portion may include the second horizontal terminal lead portion 44*b* extending horizontally and the second vertical terminal lead portion 42*b* extending vertically from one end of the second horizontal terminal lead portion 44*b*. The contact terminal 46*b* may be disposed between the two common terminals 46*a*. Cable coupling holes 48*a* and 48*b* may be formed in the first and second vertical terminal lead portions 42*a* and 42*b*, respectively. The first and second vertical terminal lead portions 42*a*, and 42*b* may be bent to be parallel to the first and second horizontal terminal lead portions 44*a*, and 44*b* after being combined with the switch cables 50*a*, 50*b* as shown in FIGS. 7 and 8.

The two common terminals 46*a* may upward diagonally extend from two points of the first horizontal terminal lead portion 44*a* to be orthogonal to and higher than the first horizontal lead portion 44*a*. Similarly, the contact terminal 46*b* may also upward diagonally extends from a point of the second horizontal terminal lead portion to be orthogonal to and higher than the second horizontal terminal lead portion 44*b*.

In an exemplary embodiment, the switch bracket 20 may be molded by the injection molding process using an insulating plastic resin such as the thermosetting resin and the like. That is, the switch bracket 20 and the stem mounting unit 22 of its top side 20*t* may be injection-molded into one body. In addition, during such injection molding, the first and second switch terminal parts 40*a* and 40*b* may be embedded in the body of the switch bracket 20 so that the switch terminal parts 40*a* and 40*b* and the switch bracket 20 may be integrally combined.

In an exemplary embodiment, portions of the first switch terminal part 40*a* and the second switch terminal part 40*b* may be embedded in and fixed by the switch bracket 20. When the switch bracket 20 is formed by the injection molding process, for example, in FIG. 8, The hatched portions which may include the first and second horizontal terminal lead portions 44*a*, and 44*b*, the top side protrusions of the common terminals 46*a* and the contact terminal 46*b*, and portions of the first and second vertical terminal lead portions 42*a* and 42*b* may be embedded in the terminal fixing piece 24 of the switch bracket 20. The end portions of the first and second horizontal terminal lead portions 44*a* and 44*b* may be exposed outside the side wall 20*a* of the switch bracket 20. The remaining portions of the first and second vertical terminal lead portions 42*a* and 42*b* may be exposed to the terminal receiving space 28 of the switch bracket 20. The top side protrusions of the common terminals 46*a* and the contact terminal 46*b* may be exposed to the switch contact receiving space 26.

Figure 9:
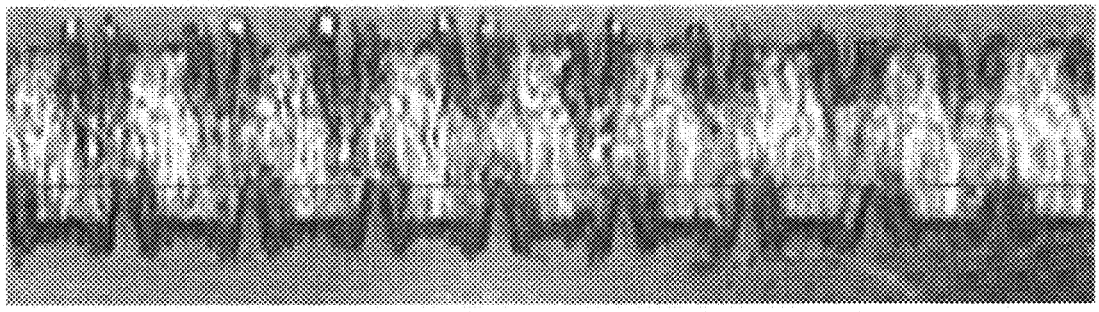
FIG. 9 is a photograph showing a partially enlarged notching structure formed by laser etching on a horizontal terminal lead portion of the switch terminal part according to an exemplary embodiment of the present invention.

In an exemplary embodiment, notching structures (or serrations) 49*a*, and 49*b* may be formed on the surfaces of the horizontal terminal lead portions 44*a*, 44*b* of the first and second switch terminal parts 40*a*, and 40*b*. FIG. 9 is a partially enlarged view of the notching structures 49*a* or 49*b* formed in the horizontal terminal lead portions 44*a* and 44*b* according to the exemplary embodiment. The notching structures 49*a* and 49*b* have a structure in which a plurality of protrusions is provided so that the surfaces of the horizontal terminal lead portions 44*a* and 44*b* are uneven. The notching structures 49*a* and 49*b* may be formed by a method such as laser etching or a press mold. The notching structures 49*a* and 49*b* may be embedded in the terminal fixing piece 24 of the switch bracket 20.

These notching structures 49*a* and 49*b* can be tightly coupled to the terminal fixing piece 24 manufactured by the injection molding process. Accordingly, it is possible to effectively block moisture from entering the terminal fixing piece 24 along the surfaces of the horizontal terminal lead portions 44*a* and 44*b* from the outside. That is, the notching structures 49*a* and 49*b* can enhance the waterproof function of the horizontal terminal lead portions 44*a* and 44*b*.

The first and second horizontal terminal lead portions 44*a*, 44*b* of the first and second switch terminal parts 40*a* and 40*b* may be embedded side by side and fixed in the terminal fixing piece 24 of the switch bracket 20. In this state, the contact terminal 46*b* of the second switch terminal part 40*b* may be located between the two common terminals 46*a* of the first switch terminal part 40*a*, and these three terminals 46*a*, 46*b* are lined up. The top surfaces of the two common terminals 46*a* and the contact terminal 46*b* may have the same height. In addition, the first vertical terminal lead portion 42*a* of the first switch terminal part 40*a* and the second vertical terminal lead portion 42*b* of the second switch terminal part 40*b* are arranged side by side in the terminal accommodating space 28.

In an exemplary embodiment, a separation wall 38 for physically separating the first and second switch terminal parts 40*a*, and 40*b* may be provided in the terminal receiving space 28 of the switch bracket 20. The separating wall 38 may have a predetermined height and a predetermined length extending from one side wall to the opposite side wall. FIG. 6 shows the separation wall 38 extending from the third side wall 20*c* toward the first side wall 20*a*. The first switch terminal part 40*a* and the second switch terminal part 40*b* may be arranged at both opposite sides about a separation wall 38 therebetween. That is, the separation wall 38 may physically separate the first switch terminal part 40*a* and the second terminal part 40*b* and support them to maintain a constant distance so that the first switch terminal part 40*a* and the second switch terminal part 40*b* can be electrically insulated by the separation wall 38.

In addition, the switch bracket 20 may include the cable guide parts 39. The cable guide parts 39 may be provided in the terminal receiving space 28 of the switch bracket 20. The ends of the cable guide parts 39 are provided on the inner surface of any one of the plurality of side walls of the switch bracket 20. FIG. 6 shows the case where the pair of cable guide parts 39 are formed in the inner surface of the first side wall 20*a* so that the cable guide parts 39 may be positioned at both sides of the separation wall 38. A cable guide groove 39-1 is formed in each cable guide part 39. A pair of cable guide grooves 39-1 may be formed in a form extending in parallel on the inner surface of the first side wall 20*a* of the switch bracket 20. Each of the cable coupling guide grooves 39-1 may be a semicircular groove suitable for receiving a round cable.

The dome-shaped contact 32 may be disposed between the stem 30 and the switch terminal unit 40. In detail, the sealing member 36 may be provided below the stem 30, and the dome-shaped contact 32 may be disposed between the sealing member 36 and the inner terminal fixing piece 24 of the switch bracket 20. The dome-shaped contact 32 is disposed convex toward the sealing member 36, so that the center of the dome-shaped contact 32 meets the center of the pushing block portion 36-2 of the sealing member 36. In the state in which the stem 30 is not pressed, only the circumferential portion of the dome-shaped contact 32 is in contact with the common terminals 46*a* of the first switch terminal part 40*a*. When the pushing block portion 36-2 of the sealing member 36 pushes the dome-shaped contact down 32 by applying an external force to the stem 30, the dome-shaped contact 32 contacts the contact terminal 46*b* of the second switch terminal part 40*b*.

The cables 50 may be connected to the switch terminal unit 40. The end portions of the first and second cables 50*a* and 50*b* where the insulating coatings are removed may be connected to the vertical terminal lead portions of the first and second switch terminal parts 40*a* and 40*b*, respectively. For example, they may be connected by soldering. The vertical terminal lead portions 42*a* and 42*b* in a linear state may be connected to the cables 50*a*, and 50*b*, respectively and then may be bent to be parallel to the horizontal terminal lead portions 44*a*, and 44*b*. The cables 50*a* and 50*b* connected to the vertical terminal lead portions 42*a* and 42*b* may extend out of the switch bracket 20 while being inserted into the cable guide groove 39-1 of the cable guide part 39. The vertical terminal lead portions 42*a* and 42*b*, and the cables 50*a* and 50*b* connected thereto are positioned in the terminal receiving space 28.

In an exemplary embodiment, the waterproof part 60 may be provided to the switch bracket 20 to waterproof the terminal receiving space 28. The waterproof part 60 may be a waterproof material that completely fills the terminal receiving space 28 of the switch bracket 20 while completely covering the vertical terminal lead portions 42*a* and 42*b* and the cables 50*a* and 50*b* connected thereto. For example, at least one of molding resins such as epoxy, silicone, and urethane, which is exemplary, may be used as the waterproof material. Other materials capable of providing a waterproof function may also be used for forming the waterproof part 60. For example, the waterproof part 60 may be formed by injecting a resin into the terminal receiving space 28, and then curing the resin. The waterproof part 60 may be referred to as a resin molding part. The waterproof part 60 may provide a waterproof function to prevent any foreign matter such as moisture from entering the terminal receiving space 28 of the switch bracket 20 from the outside.

Figure 10:
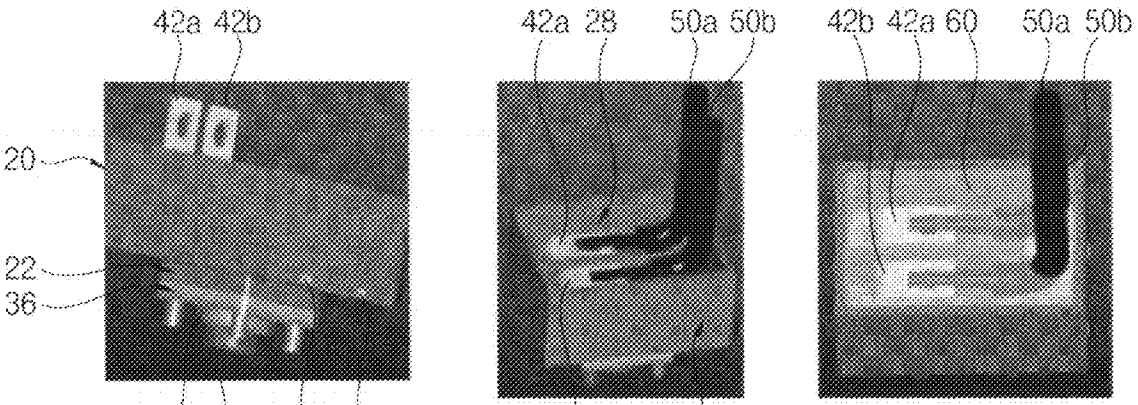
FIG. 10 schematically shows an assembly process of the waterproof switch according to an exemplary embodiment of the present invention.

FIG. 10 schematically shows an assembly process of a waterproof switch device according to an exemplary embodiment.

Referring to FIG. 10, firstly an injection mold (not shown) is prepared for manufacturing the switch bracket 20 and the stem mounting unit 22 at a time by the injection molding process. After the first and second terminal parts 40*a* and 40*b* are set into the injection mold, a molten raw material, for example, thermosetting plastics or resins may be injected into the injection mold and cured, thereby obtaining the switch bracket 20 in which the first and second terminal parts 40*a* and 40*b* are embedded and the stem mounting unit 22 is integrated. At this time, it may be needed to fix the first and second horizontal terminal lead portions 44*a* and 44*b* so that they do not move while the injection raw material is injected into the injection mold. For this, the first and second horizontal terminal lead portions 44*a* and 44*b* may have a length that can protrude out the side wall of the switch bracket 20 so that their end sections can be held by the injection mold. After the injection molding, the end sections of the first and second horizontal terminal lead portions 44*a* and 44*b* protruding out the side wall of the switch bracket 20 may be no longer required and thus may be cut out by, for example, laser cutting.

By this injection molding process, except for the end sections of the first and second vertical terminal lead portions 42*a* and 42*b* extending outward the switch bracket 20 and the common terminals 46*a* and the contact terminal 46*b* exposed on the bottom of the switch contact receiving space 26, the rest of the first and second switch terminal parts 40*a*, and 40*b*, including the first and second horizontal terminal lead portions 44*a*, and 44*b*, may be embedded in and integrated with the injection material. That is, without using the PCB employed by the prior art, it is possible to provide the switching terminals for the dome-shaped contact 32 as well as terminal lead portions which can be directly connected to the switching signal cables 50*a* and 50*b* by a simple injection molding process to integrate the first and second switch terminal parts 40*a* and 40*b* with the switch bracket 20.

Assembling the push button unit 15 with the switch bracket 20 may be performed as follows. The dome-shaped contact 32 may be placed in the switch contact receiving space 26 and be in contact with the two common terminals 46*a*. The sealing member 36 may be disposed over the dome-shaped contact 32 to cover the dome-shaped contact 32 and the stem mounting unit 22. At this time, the sealing member 36 is tightly coupled to the top side of the stem mounting unit 22 by a sealing bonding means such as a waterproof adhesive, so that the sealing member 36 can seal the switch contact receiving space having the dome-shaped contact 32 and the switch terminals 46*a*, and 46*b*. By the sealing function of the sealing member 36, the switch contact receiving space 26 can be protected as a sealed waterproof space that does not allow moisture to penetrate from the outside.

The stem 30 may be placed on the inner sink of the pushing block portion 36-2 of the sealing member 36. Then, while the upper portion of the stem 30 is inserted into the stem engaging hole 34-3, the cover 34 may be placed on the sealing member 36 to be superimposed. In this coupling process, the plurality of protruding pins 22*p* may be inserted into the pin insertion holes 36-3 of the sealing member 36 and the pin insertion holes 34-4 of the cover 34. The cover 34 may also be bonded to the sealing member 36 with adhesive. Nail heads may be formed by melting the upper ends of the plurality of protruding pins 22*p* extending out of the cover 34.

In addition, the stem 30 positioned on the sealing member 36 may be elastically supported by the dome-shaped switch contact 32. In the state in which no external force is applied to press the stem 30, the stem flange portion 30-1 may be stopped by the stem stopper 34-2 while being hung on the stem stopper 34-2. When an external force that presses down the stem 30 is applied, the stem 30 moves downward to push the sealing member 36 and thus the dome-shaped contact 32 can be pressed through the sealing member 36. The dome-shaped contact 32 in contact with the common terminal 46*a* is also in contact with the contact terminal 46*b* so that the waterproof switch device 10 can be turned on. When the external force is removed, the dome-shaped contact 32 can be separated from the contact terminal 46*b* by its elasticity.

Figure 11:
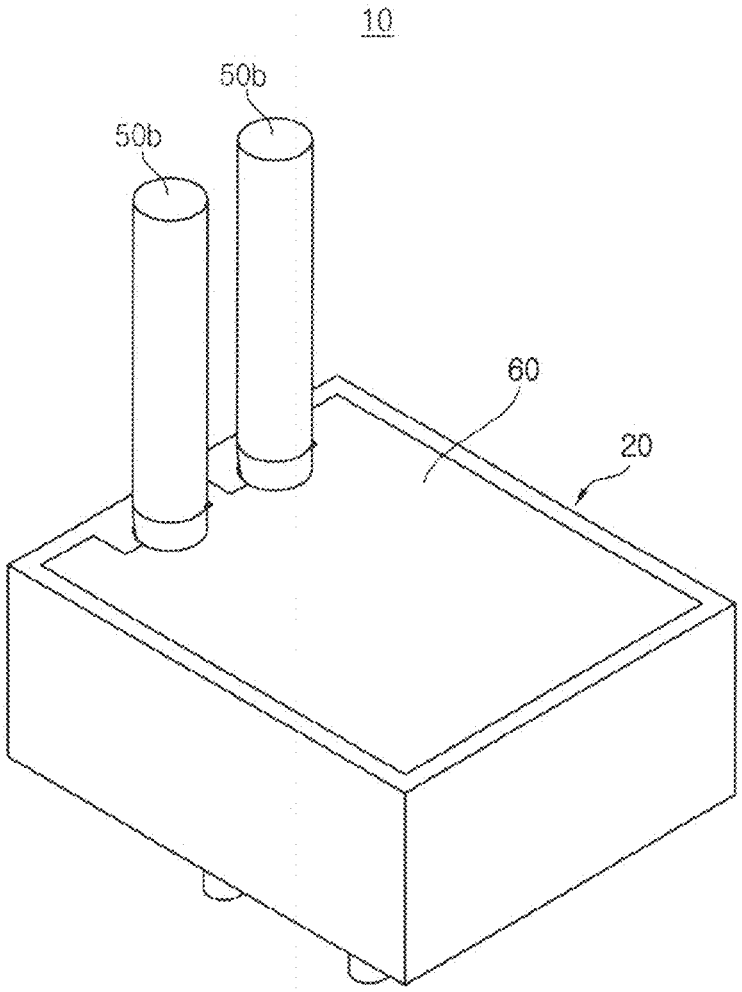
FIG. 11 is a rear perspective view of the waterproof switch according to the exemplary embodiment of the present invention.

After connecting the cables 50*a*, and 50*b* to the switch terminal parts 40*a*, and 40*b*, the switch terminal parts 40*a*, and 40*b* may be bent and placed in the terminal receiving space 28. In this state, epoxy may be injected into the terminal receiving space 28 and then cured to form the waterproof part 60. As a result, as shown in FIG. 11, the cables 50*a* and 50*b* and the switch terminal parts 40*a* and 40*b* in the terminal receiving space 28 may be completely covered by the waterproof part 60, and only the insulated sections of the cables 50*a*, and 50*b* can be extended outside the switch bracket 20, thereby resulting in a waterproof structure.

As described above, the waterproof switch device 10 according to the present invention can be manufactured in a simple structure of integrated body that can be connected to a switching signal cable without using the PCB. Since it can be manufactured through the simplified processes such as the injection molding, cable soldering, and epoxy molding without using the PCB, the number of assembly steps is reduced compared to the prior art, thereby improving productivity and lowering cost.

At the same time, the integrated waterproof switch device 10 can provide a perfect waterproof structure. The switch contact receiving space 26 in which the switch contacts 32, 46*a*, and 46*b* are located may be a waterproof space completely sealed from the outside by the sealing member 36. The terminal receiving space 28 in which the cables 50 and the terminal lead portions 42*a*, and 42*b* of the switch terminal unit 40 are present is also completely sealed by the waterproof part 60, thereby also resulting in a waterproof structure that cannot penetrate moisture from the outside.

In addition, bumpy surfaces may be formed in the horizontal terminal lead portions 44*a*, 44*b* of the first and second switch terminal part 40*a* and 40*b* by the notching structures 49*a* and 49*b*. The notching structures 49*a* and 49*b* can greatly enhance contact-tightness between the switch terminal unit 40 and the terminal fixing piece 24. Thus, these notching structures 49*a* and 49*b* can prevent moisture from penetrating along the surface of the horizontal terminal lead portions 44*a*, and 44*b* from the outside. In addition, the bumpy surfaces may form a plurality of blocking pieces between the terminal fixing piece 24 and the horizontal terminal lead portions 44*a* and 44*b*, thereby preventing a part of the molten raw material for the injection molding from penetrating into the gap between the horizontal terminal lead portions 44*a*, and 44*b* and the terminal fixing piece 24 in the process of forming the waterproof part 60 by the injection molding. It is to prevent the case where the conduction property between the dome-shaped contact 32 and the first and second terminal parts 40*a* and 40*b* is lowered or the conduction does not properly work due to the penetration of the non-conductive molten raw material. As described above, the waterproof switch device 10 according to the present invention can have a very high level of waterproofing function by sealing all passages through which moisture can flow.

In addition, in the waterproof switch device 10 according to the present invention, since the first and second switch cables 50*a*, and 50*b* comes out of the waterproof part 60 in a state that they are stably seated in the cable guide part 39 provided in the switch bracket 20, the undesired movement of the cables 50 can be prevented more reliably. It is possible to more reliably prevent the case where the conduction lines of the cables 50*a* and 50*b* are released from contact with the terminal lead portions 42*a* and 42*b* of the first and second terminals 40*a* and 40*b* by the forced movement of the cables 50*a* and 50*b*. In addition, when injecting the liquid injection molding material (for example, liquid epoxy) into the terminal receiving space 28 of the switch bracket 20, the cables 50*a* and 50*b* may be fixedly seated in the cable guide part 39. Accordingly, when injecting the liquid molding material, the cables 50*a* and 50*b* does not act as an obstacle to the formation of the waterproof part 60.

In addition, the first switch terminal part 40*a* and the second switch terminal part 40*b* cannot physically contact with each other due to the separation wall 38 provided in the switch bracket 20. Thus, while the switch is operated, the first switch terminal part 40*a* and the second switch terminal part 40*b* cannot be short-circuited, thereby preventing malfunction of the switch.

In addition, the sealing member 36 is provided with a closed-loop pushing guide protrusion portion 36-4 protruding from the top toward the bottom, so that when the sealing member 36 is pressed by the stem 30, the central portion of the sealing member 36 is evenly pressed by the pushing guide protrusion portion 36-4. Therefore, the dome-shaped contact 32 can be uniformly pressed by the center portion of the sealing member 36 so that the switching operation can be smoothly and reliably performed uniformly on.

In addition, the sealing member 36 is provided in the bottom with a pushing block portion 36-2 disposed in the inner region of the pushing guide protrusion portion 36-4. When the sealing member 36 is pressed by the stem 30, the pushing block portion 36-2 can press the center portion of the dome-shaped contact 32 more uniformly and with less force. Accordingly, the switching operation can be made more reliably by smooth contact of the dome-shaped contact 32.

In addition, since the pin insertion holes 34-4 provided around the stem coupling hole 34-3 of the cover 34 are fitted to the protruding pins 22P provided on the stem mounting unit 22 of the switch bracket 20, the cover 34 can be combined more easily and stably with the stem mounting unit 22 of the switch bracket 20.

Figure 12:
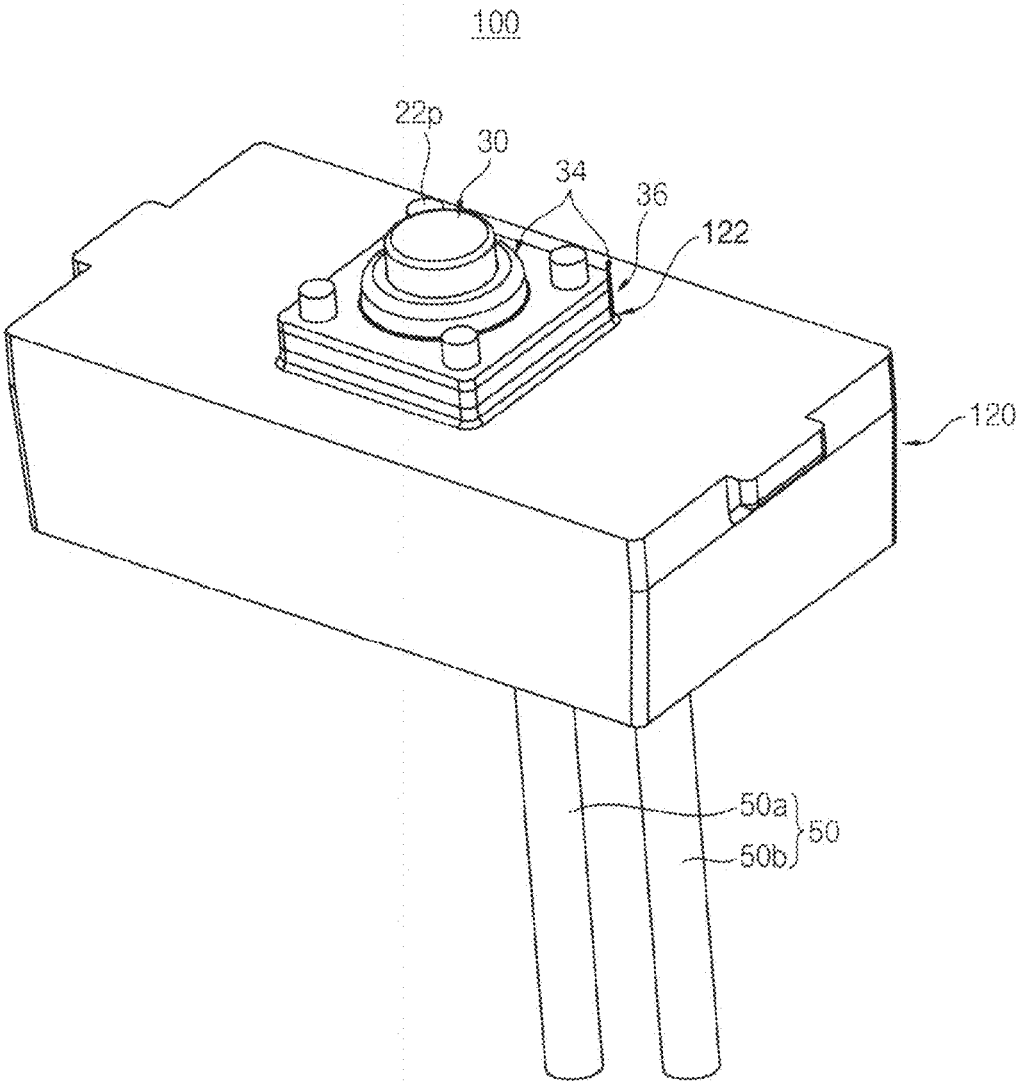
FIG. 12 is a perspective view of an assembled waterproof switch according to a second exemplary embodiment of the present invention.
Figure 13:
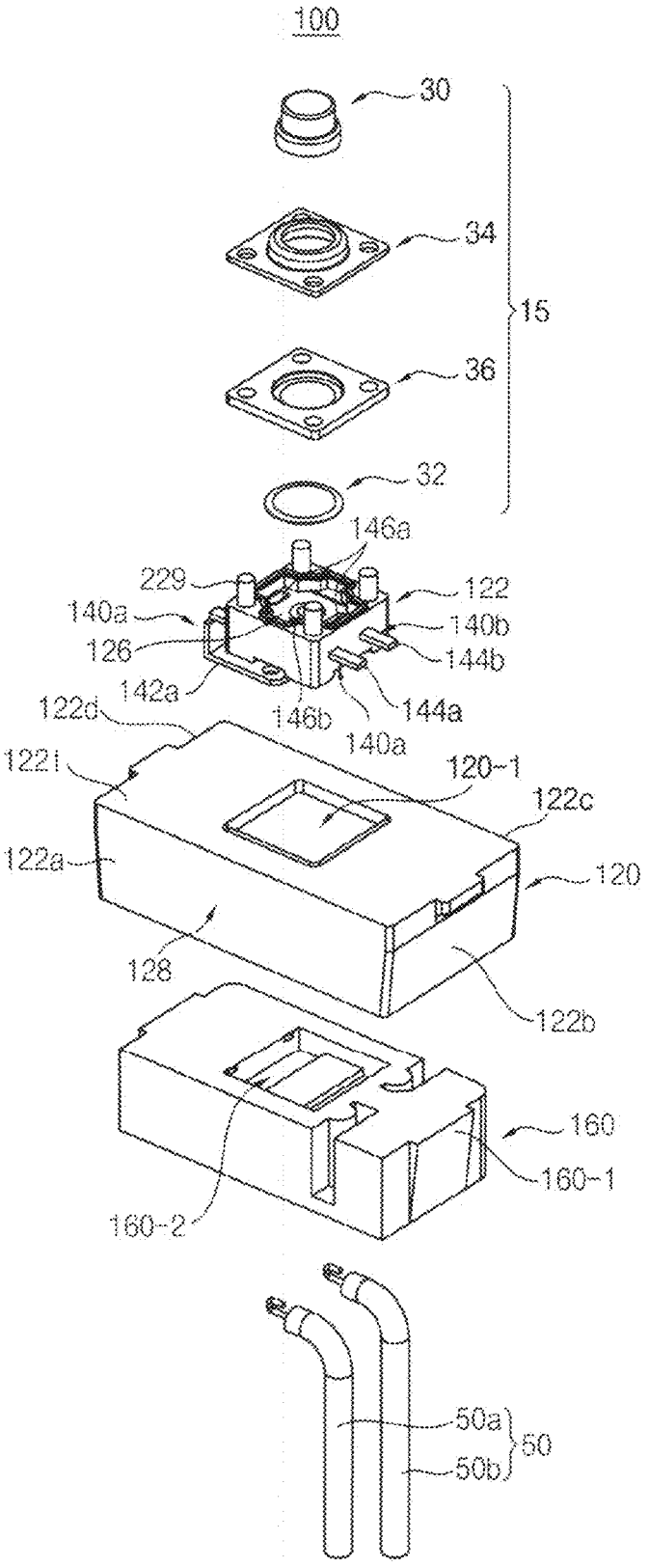
FIG. 13 is an exploded perspective view of the waterproof switch shown in FIG. 12.

Next, FIGS. 12 and 13 show an assembled state and an exploded state of the waterproof switch device 100 according to the second exemplary embodiment.

As mentioned above, in the waterproof switch device 10 according to the first embodiment, the terminal sections of the first and second horizontal terminal lead portions 44*a*, and 44*b* are extended outside the side wall of the switch bracket 20 to be used as a fixing means during the injection molding process to form the switch bracket 20. Such a structure may require separate waterproofing means for the joint surface between the first and second horizontal terminal lead portions 44*a* and 44*b*, and the switch bracket 20, and thus the notching portions 49*a*, 49*b* are provided as the waterproofing means.

With reference to FIGS. 12 and 13, the waterproof switch device 100 according to the second embodiment may include a terminal case 122 integrally coupled to the switch terminal unit 40, the push button unit 15, a switch bracket 120, the cables 50, and a waterproof part 160. The waterproof switch device 100 may have a difference from the waterproof switch device 10 of the first embodiment in that the horizontal terminal lead portions 144*a*, and 144*b* of the switch terminal unit 140 are embedded so as not to be extended outside the side walls of the switch bracket 120. Of course, the waterproof switch device 100 of the second embodiment may be also the same as the first embodiment in that it does not use the PCB. In an exemplary embodiment, firstly the first and second switch terminal parts 40*a* and 40*b* may be embedded in and integrated with the terminal case 122 by the injection molding process, and then the switch bracket 120 may be formed to be integrated with the terminal case 120 by the injection molding process. According to this, the first and second switch terminal parts 40*a* and 40*b* embedded in the switch bracket 120 may not be exposed outside through the side wall portions 122*a* to 122*d* of the switch bracket 120, and may be exposed to a terminal receiving space 128 only. Since the horizontal terminal lead portions 144*a* and 144*b* are not exposed outside the side walls of the switch bracket 120, water infiltration into the interface between the first and second horizontal terminal lead portions 144*a* and 144*b* and the switch bracket 120 is essentially impossible.

The terminal case 122 may correspond to a combination of the stem mounting unit 22 and the terminal fixing piece 24 of the waterproof switch device 10 according to the first embodiment. That is, the upper portion of the terminal case 122 may be substantially the same as the stem mounting unit 22 of the first embodiment, and the lower portion of the terminal case 122 may be substantially the same as the terminal fixing piece 24.

The first and second switch terminal parts 140*a* and 140*b* may have substantially the same configuration as the first embodiment. However, the first and second switch terminal parts 140*a* and 140*b* may be combined with the terminal case 122 first by the injection molding process with the plastic resin such as the thermosetting resin. The first and second switch terminal parts 140*a* and 140*b* may be integrally coupled with the terminal case 122 in a form in which at least middle sections of the horizontal terminal lead portions 144*a* and 144*b* are embedded in the body of the terminal case 122. Both end sections of the horizontal terminal lead portions 144*a* and 144*b* may protrude in the horizontal direction out of the two sides of the terminal case 122. As in the first embodiment, the common terminals 146*a* and the contact terminal 146*b* of the first and second switch terminal parts 140*a* and 140*b*, respectively, may be exposed on the bottom of the switch contact receiving space 126. The first and second vertical terminal lead portions 142*a* and 142*b* of the first and second switch terminal parts 140*a* and 140*b*, respectively, may vertically bent at the ends of the horizontal terminal lead portions 144*a* and 144*b* and extend downward to the outside of the terminal case 122.

The assembly of the first and second switch terminal parts 140*a* and 140*b* and the terminal case 122 may be integrally combined with the switch bracket 120 by another injection molding process. The switch bracket 120 may be injection-molded using the same raw material as the terminal case 122. Since the upper part of the terminal case 122 may protrude outside the injection mold for the switch bracket 120, the terminal case 122 may be fixed to the injection mold of the switch bracket 120 by using protruding upper part of the terminal case 122 during the resin injection.

The injection-molded switch bracket 120 may include an top side 122*a* and four side walls 122*a*, 122*b*, 122*c*, and 122*d* combined with four corners thereof, and includes a terminal receiving space 128 surrounded by them. The inner wall of the coupling hole 120-1 provided on the top side 122*t* of the switch bracket 120 may be integrally joined while surrounding the outer wall of the terminal case 122. As a result, as illustrated in FIG. 12, an upper portion of the terminal case 122 may protrude above the top side 122*t* of the switch bracket 120. In addition, the end sections of the first and second switch terminal parts 140*a* and 140*b* protruding out of the terminal case 122 may be embedded in the top side 122*t* of the switch bracket 120 so that the terminal case 122 and the switch bracket 120 can make the bond between them more solid. If the terminal case 122 is injection-molded first so that the switch terminal parts 140*a* and 140*b* can be embedded into the terminal case 122, and then the switch bracket 120 is injection-molded to be integrally joined with the terminal case 122, the first and second horizontal terminal lead portions 144*a* and 144*b* may be embedded in the top side 122*t* of the switch bracket 120 and not be exposed outside the side wall 122*b*. Therefore, moisture penetration along the first and second horizontal terminal lead portions 144*a* and 144*b* from the outside can be fundamentally blocked.

The protruding upper structure of the terminal case 122 may be substantially the same as the stem mounting unit 22 of the first embodiment. The configuration of the push button unit 15 of the first embodiment can be applied to the second embodiment as it is. Therefore, the dome-shaped contact 32 may be disposed in contact with the common terminals 146*a* in the switch contact receiving space 126 provided on the top side of the terminal case 122, and the sealing member 36 may be hermetically joined with the top side of the terminal case 122 by an adhesive while covering the switch contact receiving space 126. Furthermore, the stem 30 and the cover 34 on the sealing member 36 may be sequentially arranged while being coupled to the plurality of protruding pins 22P to be fixed to the terminal case 122.

The switch cables 50*a* and 50*b* may be connected by soldering to the first and second vertical terminal lead portions 142*a* and 142*a* of the switch terminal parts 140*a* and 140*b* respectively that come out of the terminal receiving space 128 of the switch bracket 120. Then, the first and second vertical terminal lead portions 142*a* and 142*a* may be bent in the horizontal direction so as to be placed in the terminal receiving space 128 together with the exposed conductor portions of the cables 50*a* and 50*b*. In this state, the waterproofing part 160 may be formed by injecting a molding resin to fill the terminal receiving space 128 and curing the resin. Undercut portions 160-1 may be formed on two corresponding lateral side surfaces of the waterproof part 160 so as not to be easily separated from the terminal receiving space 128 in the switch bracket 120. In addition, a pair of grooves 160-2 corresponding to the shape of the lower portion of the terminal case 122 may be formed on the top side of the waterproof part 160.

Figure 14:
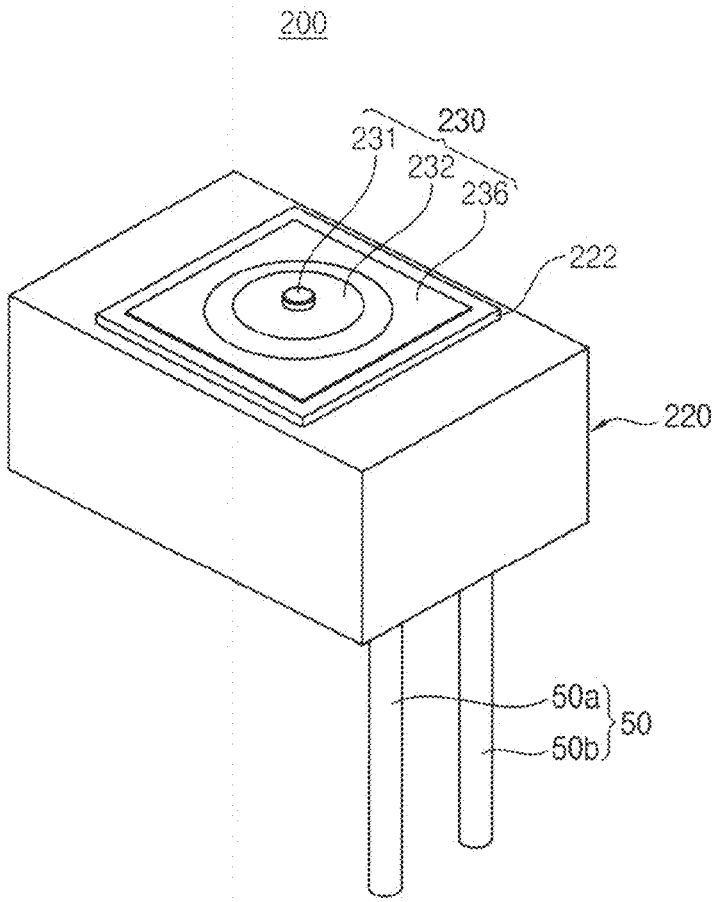
FIG. 14 is a perspective view of an assembled waterproof switch according to a third exemplary embodiment of the present invention.
Figure 15:
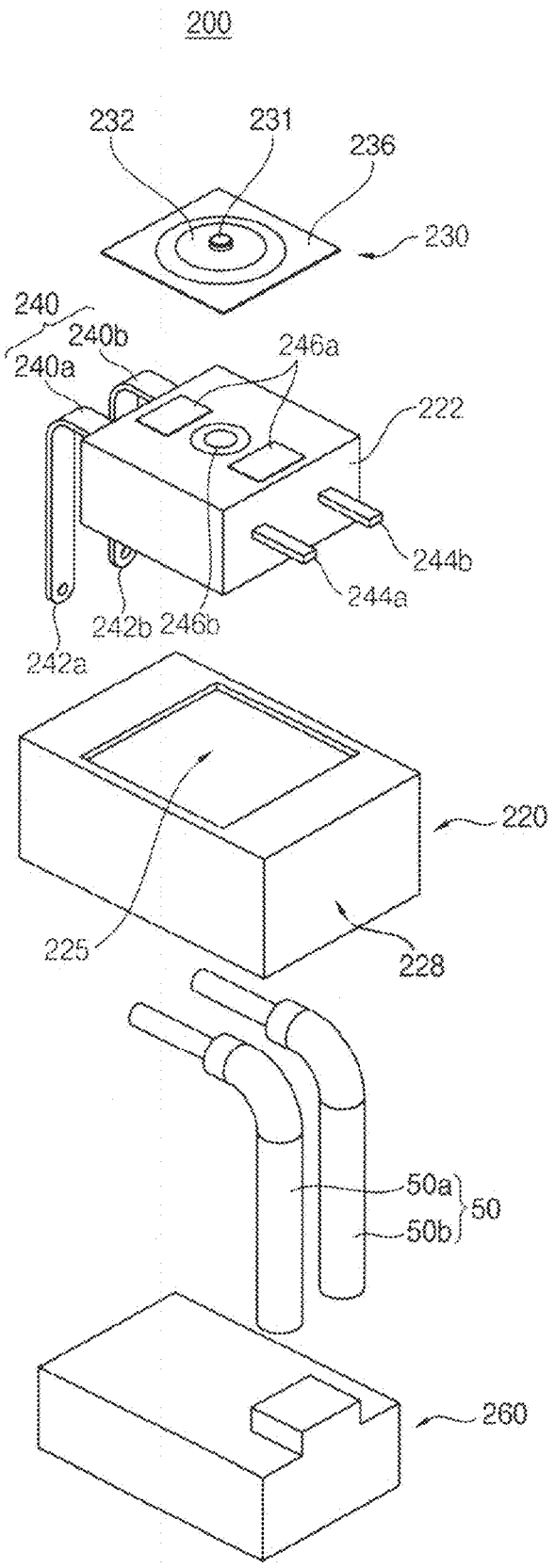
FIG. 15 is an exploded perspective view of the waterproof switch shown in FIG. 14.

FIGS. 14 and 15 illustrate a waterproof switch device 200 according to a third exemplary embodiment.

Referring to FIGS. 14 and 15, the waterproof switch device 200 according to the third embodiment may be characterized in that it has a simplified slimmer structure than those of the previous embodiment. The waterproof switch device 200 may include a push button unit 230, a switch terminal unit 240, a terminal case 222, a switch bracket 220, a waterproof part 260, and cables 50.

The push button unit 230 may include a dome-shaped contact 232 and a waterproof cover 236. The dome-shaped contact 232 may be the same as the dome-shaped contact 32 of the first or second embodiment. That is, the dome-shaped contact 232 may be an elastic conductor and may have a circular dome shape. The waterproof cover 236 may have a sufficient size to contain the dome-shaped contact 32 and the first and second switch terminals 246*a* and 246*b*. The waterproof cover 236 may be hermetically sealed to the top side of the switch bracket 220 while covering the dome-shaped contact 32 and the first and second switch terminals 246*a* and 246*b*. The waterproof cover 236 may be made of, for example, a thermoplastic resin film such as a polyethylene terephthalate film or a thermosetting film such as a polyimide (PI) film. The waterproof cover 236 made from such a resin film may be fused to the top side of the terminal case 222 by applying heat, for example. The waterproof cover 236 may also be made from rubber or silicone, for example. In this case, the waterproof cover 236 may be bonded to the top side of the terminal case 222 using, for example, adhesive.

By such sealing bonding, the waterproof cover 236 can seal a switching contact space, which contains the dome-shaped contact 232 and the terminals 246*a* and 246*b* protruding on the top side of the terminal case 222, in cooperation with the top side of the terminal case 222 or the top side of the switch bracket 220. That is, the waterproof cover 236 can provide a waterproof function to block the penetration of moisture into the switching contact space, so that the waterproof cover 236 can replace the role of the sealing member 36 of the first and second embodiments.

The push button unit 230 may further include a protruding button 231 protruding upward from a central portion of the dome-shaped contact 232. The protruding button 231 can help the user to more reliably press the dome-shaped contact 232. The protruding button 231 may be joined to the outer surface of the waterproof cover 236. As another example, the protruding button 231 may be directly bonded to the top surface of the dome-shaped contact 232 or integrally formed with the dome-shaped contact 232. In this case, the waterproof cover 236 may cover the dome-shaped contact 232 and the protruding button 231 together.

The switch terminal unit 240 may include a pair of switch terminal parts 240*a* and 240*b* having the same configuration as the previous embodiments.

As in the second embodiment, the terminal case 222 integrally coupled with the switch terminal unit 240 may be made by the injection molding process with the resin raw material. Then, the switch bracket 220 may be made to be integrally coupled with the combination of the switch terminal unit 240 and the terminal case 222 by the injection molding process with the resin raw material. The switch bracket 220 may provide the terminal receiving space 228 surrounded by the top side and four side walls.

Through this two-staged injection molding process an assembly that includes the switch bracket 220 and the terminal case 222 integrally coupled to the top side thereof, and the switch terminal unit 240 partially embedded in and integrally coupled to the terminal case 222 can be obtained. At this time, the common terminals 246*a* and the contact terminal 246*b* of the switch terminal unit 240 protrude on the top side of the terminal case 222, and the first and second vertical terminal lead portions 242*a* and 242*b* of the switch terminal unit 240 extend downward. Subsequently, as in the second embodiment, the first and second vertical terminal lead portions 242*a* and 242*b* may be connected to the cables 50*a* and 50*b*, then bent at right angles to be parallel with the first and second horizontal terminal lead portions 242*a* and 242*b*, respectively, and positioned in the terminal receiving space 228. The waterproof part 260 may be formed by injecting and curing a waterproof material in the terminal receiving space 228.

As another example, in a state in which the switch terminal unit 240 is fixed to the injection mold, the terminal case 222 and the switch bracket 220 may be molded together through one-time injection molding process as in the first embodiment.

In the waterproof switch device 200 according to the third embodiment, the waterproof function of the upper side and the lower side can be implemented through the waterproof cover 236 and the waterproof part 260 and thus provides a waterproof performance equivalent to the second embodiment. The thickness of the terminal case 222 can be significantly reduced by simplifying the structure of the push button unit 230 compared to the first and second embodiments. In the result, the waterproof switch device 200 may have a simplified and slim structure as a whole. For the waterproof switch device 200, the number of parts is reduced and the assembly process is simplified compared to the first and second embodiments because no components such as the stem, the cover, the sealing member, etc. used for the waterproof switch devices 10 and 100 according to the first and second embodiments are required and what is needed for assembling is just to bond the waterproof cover 236 coupled with to the dome-shaped contact 232 to the terminal case 222.

Figure 16:
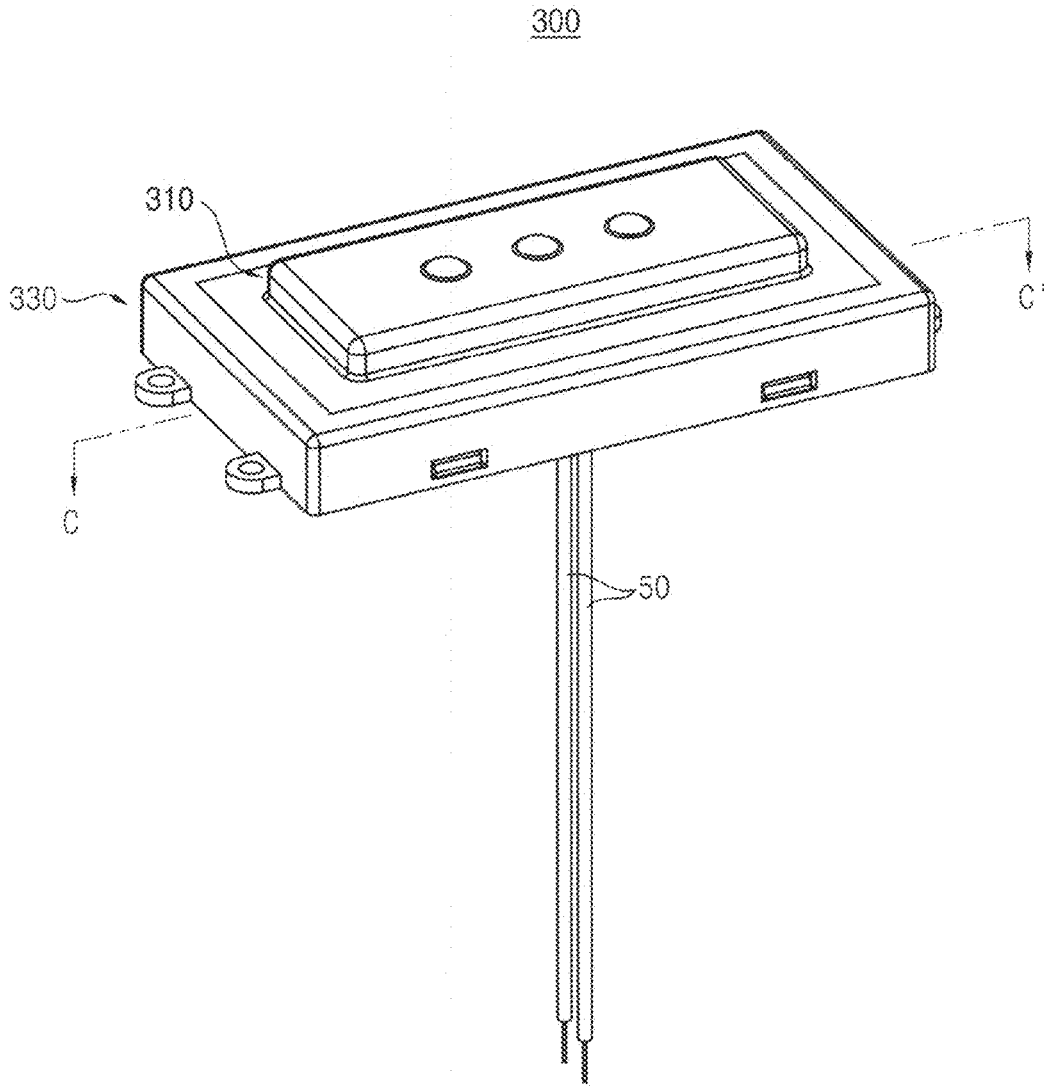
FIG. 16 is a perspective view showing an assembled waterproof switch module for a vehicle trunk door to which the waterproof switch according to exemplary embodiments of the present invention is applied.
Figure 17:
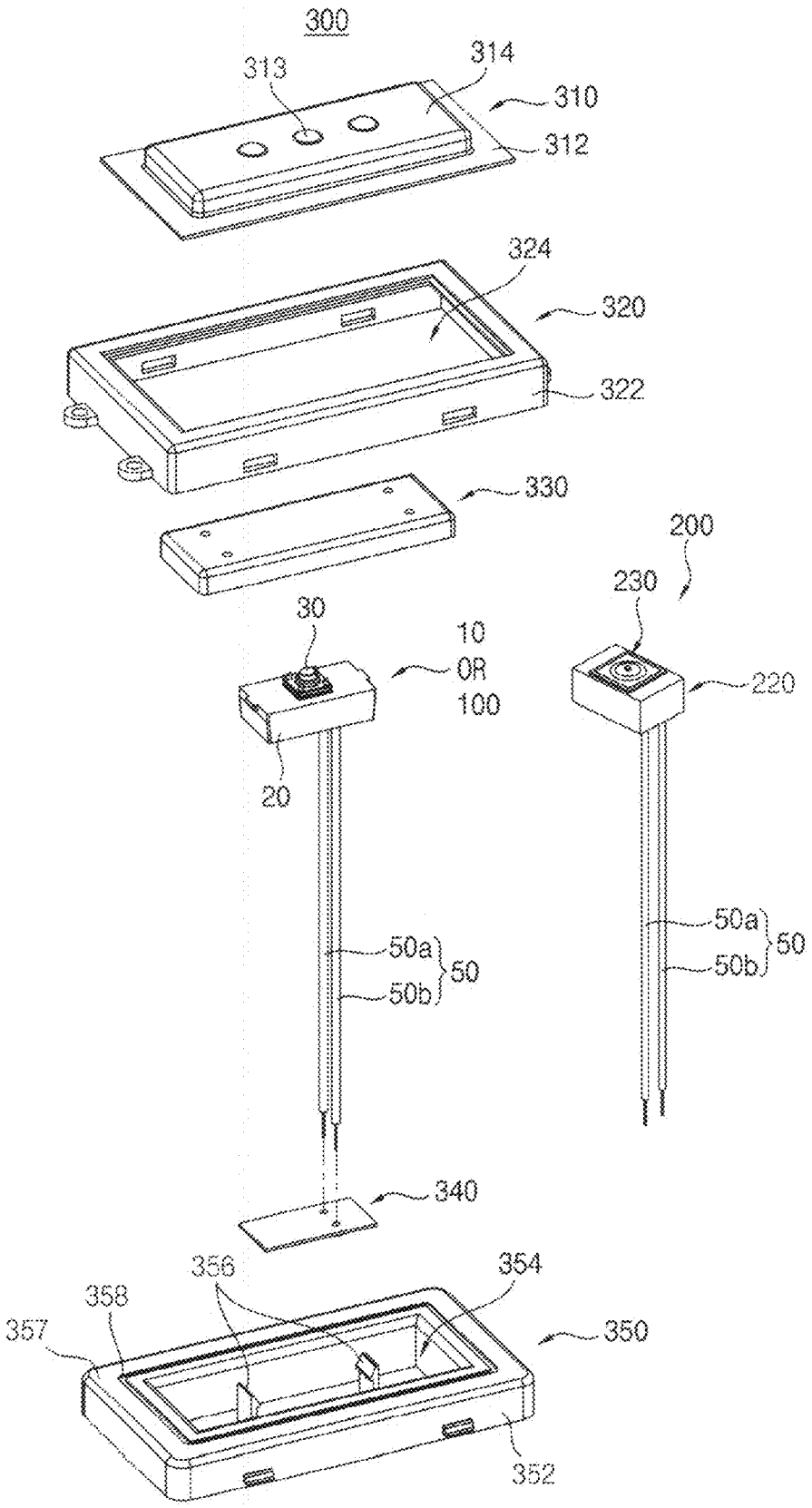
FIG. 17 is an exploded perspective view of the waterproof switch module for the vehicle trunk door shown in FIG. 16.
Figure 18:
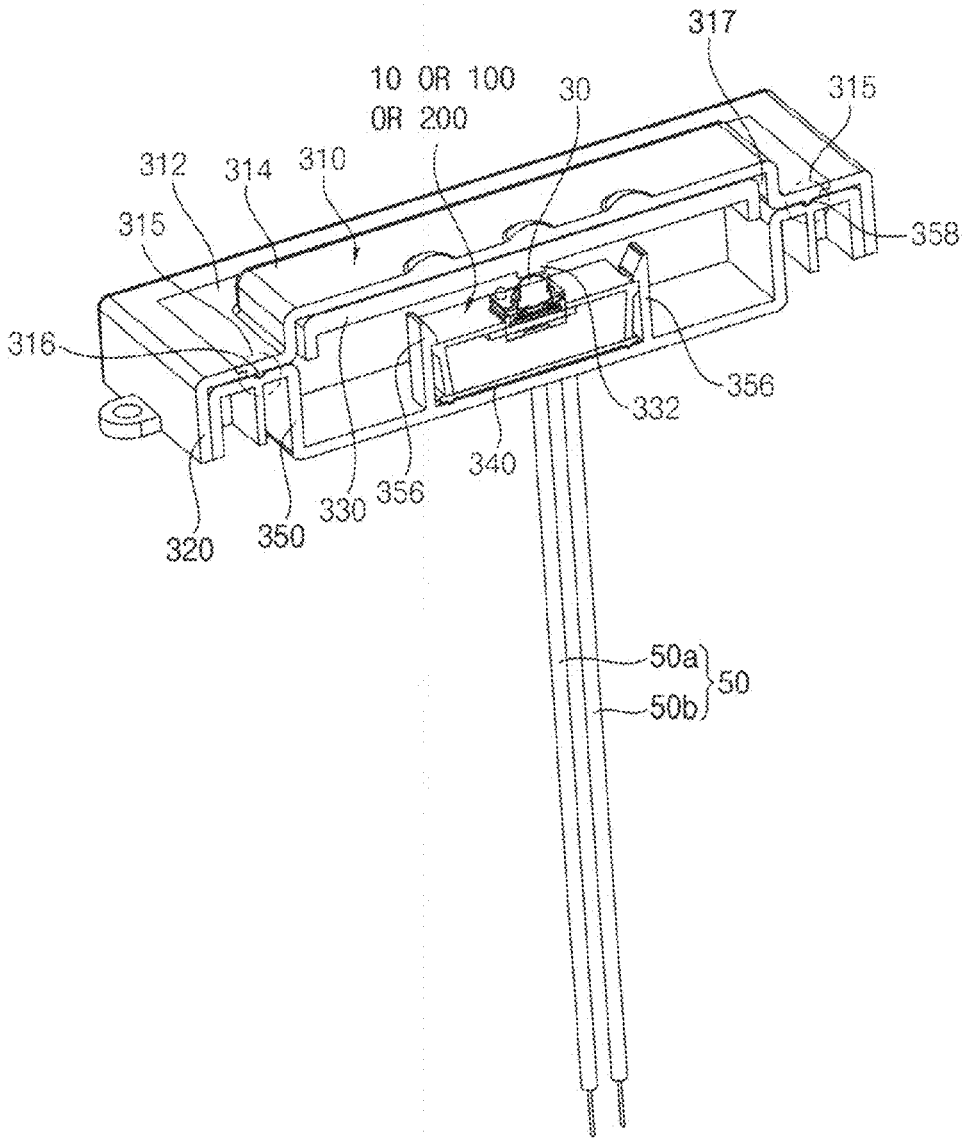
FIG. 18 is a cross-sectional view taken along line C-C' in FIG. 16.

Meanwhile, FIGS. 16 to 18 show a waterproof switch module 300 for a vehicle trunk door to which the waterproof switch device 10, 100, or 200 may be applied according to an exemplary embodiment of the present invention.

Referring to FIGS. 16 to 18, the waterproof switch module 300 may include the waterproof switch device 10, 100 or 200 described above and a switch case configured to house it and apply to the vehicle trunk door.

In an exemplary embodiment, the switch case may include elastic pressing parts 310 and 330, an upper case 320, and a lower case 350. The switch case may further include an elastic waterproof pad 340.

The lower case 350 may be a substantially rectangular case 352 that is surrounded by a bottom and four side walls to provide a switch storage space 354 with an open-top. In addition, the lower case 350 may include an upper outer rim 357 extending in a predetermined width in an outer horizontal direction from the top of four side walls. A waterproofing groove 358 may be provided on the upper outer rim 357 along a closed-loop that completely surrounds the periphery of the switch storage space 354.

In addition, the lower case 350 may include a pair of switch supports 356, which may be fixed upright on the bottom, being spaced apart from each other, and being provided with locking jaws at the upper portion, respectively. The waterproof switch device 10, 100, or 200 may be inserted between the pair of switch supports 356. The waterproof switch device 10, 100, or 200 may be elastically supported by the pair of switch supports 356, and can be fixed so as not to be separated by the locking jaws. The cables 50 of the waterproof switch device 10, 100, or 200 may extend out through the bottom of the lower case 350.

The elastic waterproof pad 340 may be disposed between the pair of switch supports 356 on the bottom of the lower case 350. The waterproof switch device 10, 100, or 200 may be placed on the elastic waterproof pad 340. The elastic waterproof pad 340 may enhance waterproof performance of the lower side of the waterproof switch device 10, 100, or 200.

The upper case 320 may include a quadrangular photo frame structure including four side walls and an upper edge 326 and provide a receiving space 324 therein. The lower case 350 may be fitted into the receiving space 324 of the upper case 320.

The elastic pressing parts may include an elastic pressing member 310. The elastic pressing member 310 may include a raised portion 314 providing a knob receiving space 317, and a bottom edge portion 312 extending a predetermined width in the outer horizontal direction from the bottom of the raised portion 314. The elastic pressing member 310 may be made of, for example, an elastic material such as rubber or silicone. The bottom edge portion 312 may be provided with a close-looped waterproofing protrusion 316 on its bottom to surround the raised portion 314. One or more protrusions 313 may be provided on the top of the elastic pressing member 310 to facilitate a switching pressing operation. The elastic pressing member 310 may be coupled to the upper case 320 to cover and close the opened top of the receiving space 324 of the upper case 320. The waterproofing protrusion 316 may be inserted into the close-looped waterproofing groove 358 to form a waterproofing structure 315. Water penetration into the space in which the waterproof switch device 10, 100, or 200 is received can be blocked by the waterproof structure 315.

Contrary to the above configuration, the waterproofing protrusion 316 and the waterproofing groove 358 may be provided on the lower case 350 and the elastic pressing member 310, respectively.

The elastic pressing portion may include a knob 330. The knob 330 may be received in the knob receiving space 317 of the elastic pressing member 310. The top side of the knob 330 may abut the inner surface of the raised portion 314, with covering the open top of the lower case 350. The bottom of the knob 330 may be provided with a protrusion 332 in contact with the push button unit 15 or 230 of the waterproof switch device 10, 100, or 200. When a force pressing the raised portion 314 of the elastic pressing member 310 is applied, the force is transmitted to the push button unit 15 or, 230 of the waterproof switch device 10, 100, or 200 through the projection portion 332, thereby pressing the dome-shaped contact 32 or 232.

The waterproof switch module 300 for the vehicle trunk door may have a double waterproof structure: one is the waterproof structure of the waterproof switch device 10, 100, or 200, and the other is the waterproof structure 315 provided by the waterproofing groove and the waterproofing protrusion 316, and the waterproof structure provided by the elastic waterproof pad 340.

In the above, the case where the waterproof switch device 10, 100, or 200 is applied to the vehicle trunk door is described as an example, but the waterproof switch device 10, 100, or 200 can be applied to devices or structures used in various environments that require waterproof properties.

As described above, although the embodiments have been described by a limited drawing, those skilled in the art variously modify the present invention without departing from the spirit and scope of the present invention as set forth in the claims below. And can be changed. Therefore, other implementations, other embodiments, and equivalents to the claims are also within the scope of the following claims.

What is claimed is:

1. A waterproof switch device, comprising:

a switch bracket including a top side and sidewalls, and providing a terminal receiving space surrounded by the top side and the side walls;

first and second switch terminal parts including first and second switch terminals, each of which is at least partially exposed to an outer surface of the top side of the switch bracket, and first and second terminal lead portions, each of which is at least partially exposed to the terminal receiving space, respectively, wherein a first remaining portion of the first switch terminal and the first terminal lead portion, and a second remaining portion of the second switch terminal and the second terminal lead portion are embedded inside the switch bracket to be integral with the switch bracket;

first and second switch cables of which terminal wires are electrically connected to the exposed portions of the first and second terminal leads, respectively, and located in the terminal receiving space, and the remaining sections of the first and second switch cables are extended out of the terminal receiving space;

a push button unit including a switch contact disposed to turn on or off the first and second switch terminals according to whether a pressing force is applied or not, and is coupled to the top side of the switch bracket such that a switch contact space receiving the first and second switch terminals and the switch contact is sealed to be waterproof; and a waterproof part filling the terminal receiving space so that the exposed portions of the first and second terminal lead portions and the first and second switch cables in the terminal receiving space are completely embedded to be waterproof in the waterproof part, wherein the switch bracket comprises a terminal case including a stem mounting unit and a terminal fixing piece, wherein the stem mounting unit provides the switch contact receiving space which is surrounded by a side wall of a certain height on the top side and has an open top, wherein the terminal fixing piece is positioned below the stem mounting unit while forming a bottom of the switch contact receiving space, and wherein the first and second remaining portions of the first and second switch terminal parts, respectively, are embedded in the terminal fixing piece.

2. The waterproof switch device of claim 1, wherein the switch bracket is an insulating plastic manufactured by an injection molding process so that the first and second remaining portions of the first and second switch terminal parts are embedded therein.

3. The waterproof switch device of claim 1, wherein ends of the first and second remaining portions of the first and second switch terminal parts embedded in the switch bracket are extended to a side wall of the switch bracket and exposed to an outside, and surfaces of predetermined sections up to the ends of the first and second remaining portions are formed with bumpy notching structures for preventing moisture from permeating along the surfaces, respectively.

4. The waterproof switch device of claim 1, wherein the waterproof part is formed using a resin filled and cured in the terminal receiving space, and wherein the resin includes at least one of epoxy, silicone, and urethane.

5. The waterproof switch device of claim 1, wherein the push button unit includes the switch contact disposed in the switch contact receiving space to maintain contact with the first switch terminal at all times, and configured to be contacted with the second switch terminal only while a downward pressure is applied to the switch contact; a sealing member hermetically configured to be sealed to a top side of the stem mounting portion so that the switch contact receiving space is completely covered and waterproof, and configured to be in contact with or close to a top surface of the switch contact; a stem disposed on the sealing member, and being a cylindrical shape having a stepped lateral side by a lower portion of the stem which is thicker than an upper portion of the stem; and a cover configured to be coupled with the sealing member while being superimposed on the sealing member, to allow the upper portion of the stem to insert therethrough, to prevent the lower portion of the stem from escaping out of the cover by engaging the stepped lateral side, and to provide a space for the stem to move up and down.

6. The waterproof switch device of claim 5, wherein the sealing member comprises an annular flat portion that is sealingly bonded to the entire top side of the stem mounting portion by a waterproof adhesive; an annular pushing guide protrusion protruding outward while being surrounded by the flat portion and sinking downward; and a pushing block portion protruding downward a center of the pushing guide protrusion and disposed in contact or close to a center portion of the top side of the dome-shaped contact so as to uniformly press the dome-shaped contact, wherein the annular flat portion, the pushing guide protrusion, and the pushing block portion form a single body.

7. The waterproof switch device of claim 5, the sealing member is made of any one of rubber, silicone, and urethane having a waterproof property.

8. The waterproof switch device of claim 5, wherein the switch contact is a dome-shaped elastic conductor of which central portion is convex, so that the switch contact can be deformed into a shape that the central portion comes to be substantially equal to the edge portion in level by a downward pressure applied to the central portion, and can be restored to an original dome shape when the downward pressure is released.

9. The waterproof switch device of claim 1, wherein the switch bracket further comprises a partition wall protruding downward from a bottom surface of the terminal fixing piece in the terminal receiving space to physically separate the first and second switch terminal parts.

10. The waterproof switch device of claim 9, wherein the switch bracket further comprises cable guide portions formed on an inner surface of the side wall side by side on both sides of the separation wall, and configured to receive the first and second switch cables to guide the first and second switch cables to be located on both sides of the separation wall.

11. The waterproof switch device of claim 1, wherein the first and second switch terminal parts are configured such that they are exposed only to the terminal receiving space without being exposed through the side wall of the switch bracket.

12. The waterproof switch device of claim 1, wherein the push button unit includes a switch contact configured to be disposed on the first and second switch terminals to maintain contact with the first switch terminal at all times, and to be contacted with the second switch terminal only while a downward pressure is applied; and a waterproof cover bonded to the top side of the switch bracket while covering all of the first and second switch terminals and the switch contact, thereby sealing a receiving space, which is formed in cooperation with the top side of the switch bracket to encapsulate the first and second switch terminals and the switch contact, to be waterproof.

13. A waterproof switch module for a vehicle trunk door, comprising:

a waterproof switch device according to claim 1;

a case unit including upper and lower cases that are press-fitted to each other and configured to provide a waterproof switch receiving space containing the waterproof switch device, wherein a central portion of the upper case is opened, and a close-looped groove or convex for waterproofing is formed along a periphery of the receiving space on a top side of the lower case; and an elastic pressing part configured to be combined with the upper case to completely cover the open central portion of the upper case, wherein the close-looped convex or groove for waterproofing formed circumferentially along an edge of the elastic pressing unit is press-fitted into the close-looped groove or convex for waterproofing formed on the lower case to block water penetration into the waterproof switch receiving space, and wherein a portion of a bottom of the elastic pressing part is disposed to contact the push button unit of the waterproof switch device.

14. The waterproof switch module for a vehicle trunk door of claim 13, wherein the lower case includes a pair of switch support parts fixed upright to the bottom, spaced apart from each other, and provided with a locking jaw at an upper portion, wherein the pair of switch support parts elastically support the press-fitted waterproof switch device, thereby fixing the press-fitted waterproof switch device not to be taken out.

15. The waterproof switch module for a vehicle trunk door of claim 13, further comprising an elastic waterproof pad disposed between a pair of switch supports on the bottom of the lower case, and on which the waterproof switch device is placed, thereby improving waterproofness of a lower side of the waterproof switch device.

16. The waterproof switch module for a vehicle trunk door of claim 13, wherein the switch bracket comprises a terminal case including a stem mounting unit and a terminal fixing piece, wherein the stem mounting unit provides a switch contact receiving space which is surrounded by a side wall of a certain height on the top side and has an open top, wherein the terminal fixing piece is positioned below the stem mounting unit while forming a bottom of the switch contact receiving space, and wherein the first and second remaining portions of the first and second switch terminal parts, respectively, are embedded in the terminal fixing piece.

17. The waterproof switch module for a vehicle trunk door of claim 13, wherein the push button unit includes a switch contact configured to be disposed on the first and second switch terminals to maintain contact with the first switch terminal at all times, and to be contacted with the second switch terminal only while a downward pressure is applied; and a waterproof cover bonded to the top side of the switch bracket while covering all of the first and second switch terminals and the switch contact, thereby sealing a receiving space, which is formed in cooperation with the top side of the switch bracket to encapsulate the first and second switch terminals and the switch contact, to be waterproof.

18. The waterproof switch module for a vehicle trunk door of claim 13, wherein the switch bracket is an insulating plastic manufactured by an injection molding process so that the first and second remaining portions of the first and second switch terminal parts are embedded therein.

19. The waterproof switch module for a vehicle trunk door of claim 13, wherein the waterproof part is formed using a resin filled and cured in the terminal receiving space, and wherein the resin includes at least one of epoxy, silicone, and urethane.

* * * * *